US008793906B2

(12) United States Patent
Warchola et al.

(10) Patent No.: US 8,793,906 B2
(45) Date of Patent: Aug. 5, 2014

(54) ROTATIONALLY MOLDED SNOWPLOW ASSEMBLY

(71) Applicant: Meyer Products, LLC, Cleveland, OH (US)

(72) Inventors: Martin Warchola, Medina, OH (US); James A. Kost, Willoughby, OH (US)

(73) Assignee: Meyer Products LLC, Cleveland, OH (US)

( * ) Notice: Subject to any disclaimer, the term of this patent is extended or adjusted under 35 U.S.C. 154(b) by 45 days.

(21) Appl. No.: 13/657,163

(22) Filed: Oct. 22, 2012

(65) Prior Publication Data

US 2014/0109445 A1 Apr. 24, 2014

(51) Int. Cl.
*E01H 5/04* (2006.01)
*E01H 5/06* (2006.01)

(52) U.S. Cl.
USPC ..... 37/231; 37/266; 37/279; 37/283; 179/272; 179/811

(58) Field of Classification Search
USPC ..... 37/231, 264, 266, 267, 272, 273; 172/810, 811, 817, 272, 273
See application file for complete search history.

(56) References Cited

U.S. PATENT DOCUMENTS

| | | | | |
|---|---|---|---|---|
| 2,867,921 | A | 1/1959 | Brown | |
| 3,477,149 | A | 11/1969 | Wagner | |
| 4,833,799 | A | 5/1989 | Harte | |
| 5,509,219 | A | 4/1996 | Mecca | |
| 6,202,328 | B1 | 3/2001 | Fulton | |
| 6,516,544 | B1 | 2/2003 | Matisz | |
| 7,676,964 | B2 * | 3/2010 | Schmeichel | 37/268 |
| 7,735,245 | B2 * | 6/2010 | Schmeichel | 37/231 |
| 7,784,199 | B2 | 8/2010 | Schmeichel | |
| 2003/0182824 | A1 * | 10/2003 | Coffin et al. | 37/266 |
| 2007/0084088 | A1 * | 4/2007 | Shepherd | 37/231 |
| 2011/0192061 | A1 * | 8/2011 | Schmeichel | 37/231 |

OTHER PUBLICATIONS

International Search Report; PCT/US97/19504: Mailed Jan. 23, 1998.

* cited by examiner

*Primary Examiner* — Matthew D Troutman
(74) *Attorney, Agent, or Firm* — Roger D. Emerson; Timothy D. Bennett; Emerson Thomson Bennett

(57) ABSTRACT

A snowplow assembly may include a vehicle attachment component, a blade support component and a snowplow blade that are each formed in a rotational molding process. These components may be manually assembled and manually attached to the vehicle. The snowplow blade may be manually positioned adjusted.

20 Claims, 20 Drawing Sheets

ROTATIONALLY MOLDED SNOWPLOW ASSEMBLY

I. BACKGROUND

A. Field of Invention

This invention pertains to the art of methods and apparatuses for snowplow assemblies and more specifically to methods and apparatuses for a manually assembled, manually attached and manually adjusted snowplow assembly.

B. Description of the Related Art

It is well known to provide snowplow assemblies for use in moving snow and ice from roads, driveways, parking lots, sidewalks and other such surfaces. Typically, the snowplow assembly is suitable to be attached to a particular vehicle, such as a pickup truck or an All-Terrain Vehicle (ATV). When the vehicle is moved, the snow contact surface of the snowplow blade contacts and plows the snow.

Known snowplow assemblies range in their weight and complexity usually depending on the application requirements. Relatively heavy and complex snowplow assemblies often use hydraulic systems and remote controls that permit the operator to adjust the position of the snowplow blade from inside the vehicle that is carrying the snowplow assembly. While such snowplow assemblies often work well for their intended purposes, they have the disadvantages of being relatively heavy, complex and expensive.

Relatively lightweight snowplow assemblies are also known. U.S. Pat. No. 6,516,544 to Matisz, for example, provides a snowplow that consists of two blade wing sections made by a rotational molding process that are joined at the center. Each blade wing section has an integrally formed bumper column that is adapted to contact the bumper of a vehicle. It is quite difficult, however, to attach the blade wing sections to the vehicle. O-rings must be attached to the vehicle. Straps must then be carefully threaded through the O-rings and the snowplow in order to mount the snowplow to the vehicle. Furthermore, once the snowplow is attached to the vehicle, it cannot be position adjusted. Thus, desirable features such as snowplow blade height adjustment and snowplow blade angle adjustment are not possible.

What is needed, then, is a snowplow assembly that is relatively lightweight yet can be easily mounted to a vehicle. Furthermore, it is desirable to have a lightweight snowplow assembly that includes a snowplow blade that is easily positioned adjusted.

II. SUMMARY

According to one embodiment of this invention, a snowplow assembly may comprise: a mounting member that is mountable to an associated vehicle to support the snowplow assembly to the associated vehicle; a hollow vehicle attachment component formed in a rotational molding process and comprising: a surface that is attached to the mounting member; first and second arms; first and second channels; and, a hole; a hollow blade support component formed in a rotational molding process and comprising: first and second arms; first and second channels; first and second holes; a slot; and, an opening; wherein the first arm of the vehicle attachment component is received in the first channel of the blade support component; the second arm of the vehicle attachment component is received in the second channel of the blade support component; the first arm of the blade support component is received in the first channel of the vehicle attachment component; and, the second arm of the blade support component is received in the second channel of the vehicle attachment component; a hollow snowplow blade formed in a rotational molding process and comprising: a snow contact surface designed to contact and plow associated snow; first and second holes; and, a first opening; a first connection pin that is manually insertable into the first opening in the snowplow blade and into the opening in the blade support component to pivotally attach the snowplow blade to the blade support component about the first connection pin; a second connection pin that is manually adjustable into: (1) a first condition where the second connection pin is removed from at least one of the first hole in the blade support component and the hole in the vehicle attachment component to permit the blade support component to slide relatively downward with respect to the vehicle attachment component as the first arm of the vehicle attachment component slides relative to the first channel of the blade support component, the second arm of the vehicle attachment component slides relative to the second channel of the blade support component, the first arm of the blade support component slides relative to the first channel of the vehicle attachment component and the second arm of the blade support component slides relative to the second channel of the vehicle attachment component so that the snowplow blade is positioned at a snowplow operation height with respect to an associated ground surface; (2) a second condition where the second connection pin is inserted into the first hole in the blade support component and into the hole in the vehicle attachment component to maintain the snowplow blade in a positioned that is above the snowplow operation height; and, (3) a third condition where the second connection pin is inserted into the slot in the blade support component and into the hole in the vehicle attachment component so that the snowplow blade and the blade support component can float up and down with respect to the vehicle attachment component based on the snowplow blade's contact with the associated ground surface; and, a third connection pin that is manually adjustable into: (1) a first condition where the third connection pin is inserted into the first hole in the snowplow blade and the second hole in the blade support component so that the snowplow blade is positioned at a first angle with respect to the associated vehicle; and, (2) a second condition where the third connection pin is inserted into the second hole in the snowplow blade and the second hole in the blade support component so that the snowplow blade is positioned at a second angle with respect to the associated vehicle that is significantly different than the first angle.

According to another embodiment of this invention, a snowplow assembly may comprise: a mounting member that is mountable to an associated vehicle to support the snowplow assembly to the associated vehicle; a hollow vehicle attachment component formed in a rotational molding process and comprising: a surface that is attached to the mounting member; a first arm; a first channel; and, a hole; a hollow blade support component formed in a rotational molding process and comprising: a first arm; a first channel; a first hole; and, an opening; wherein the first arm of the vehicle attachment component is received in the first channel of the blade support component and the first arm of the blade support component is received in the first channel of the vehicle attachment component; a hollow snowplow blade formed in a rotational molding process and comprising: a snow contact surface designed to contact and plow associated snow; and, a first opening; a first connection pin that is insertable into the first opening in the snowplow blade and into the opening in the blade support component to attach the snowplow blade to the blade support component; a second connection pin that is adjustable into: (1) a first condition where the second connection pin is removed from at least one of the first hole in the blade support component and the hole in the vehicle attachment component to permit the blade support component to move relatively downward with respect to the vehicle attachment component as the first arm of the vehicle attachment component moves relative to the first channel of the blade support component and the first arm of the blade support component moves relative to the first channel of the vehicle attachment component so that the snowplow blade is positioned at a snowplow operation height with respect to an associated ground surface; and, (2) a second condition where the second connection pin is inserted into the first hole in the blade support component and into the hole in the vehicle attachment component to maintain the snowplow blade in a positioned that is above the snowplow operation height.

According to yet another embodiment of this invention, a method may comprise the steps of: (A) providing a snowplow assembly comprising: (1) a mounting member; (2) a hollow vehicle attachment component formed in a rotational molding process and comprising: a surface that is attached to the mounting member; a first arm; a first channel; and, a hole; (3) a hollow blade support component formed in a rotational molding process and comprising: a first arm; a first channel; a first hole; and, a first opening; and, (4) a hollow snowplow blade formed in a rotational molding process and comprising: a snow contact surface designed to contact and plow associated snow; a first opening; (5) a first connection pin; and, (6) a second connection pin; (B) attaching the vehicle attachment component to the associated vehicle by manually mounting the mounting member to the associated vehicle; (C) attaching the blade support component to the vehicle attachment component by manually inserting: the first arm of the vehicle attachment component within the first channel of the blade support component; and, the first arm of the blade support component within the first channel of the vehicle attachment component; (D) attaching the snowplow blade to the blade support component by manually inserting: the first connection pin into the first opening in the snowplow bade and into the first opening in the blade support component; and, (E) positioning the snowplow blade to an above snowplow operation height by: (1) manually sliding the blade support component upward with respect to the vehicle attachment component by sliding the first arm of the vehicle attachment component relative to the first channel of the blade support component and sliding the first arm of the blade support component relative to the first channel of the vehicle attachment component; and, (2) manually inserting the second connection pin into the first hole in the blade support component and into the hole in the vehicle attachment component.

One advantage of this invention is that a snowplow assembly can be easily and manually assembled and attached to a vehicle.

Another advantage of this invention is that a snowplow assembly can be easily and manually position adjusted.

Other benefits and advantages of this invention will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
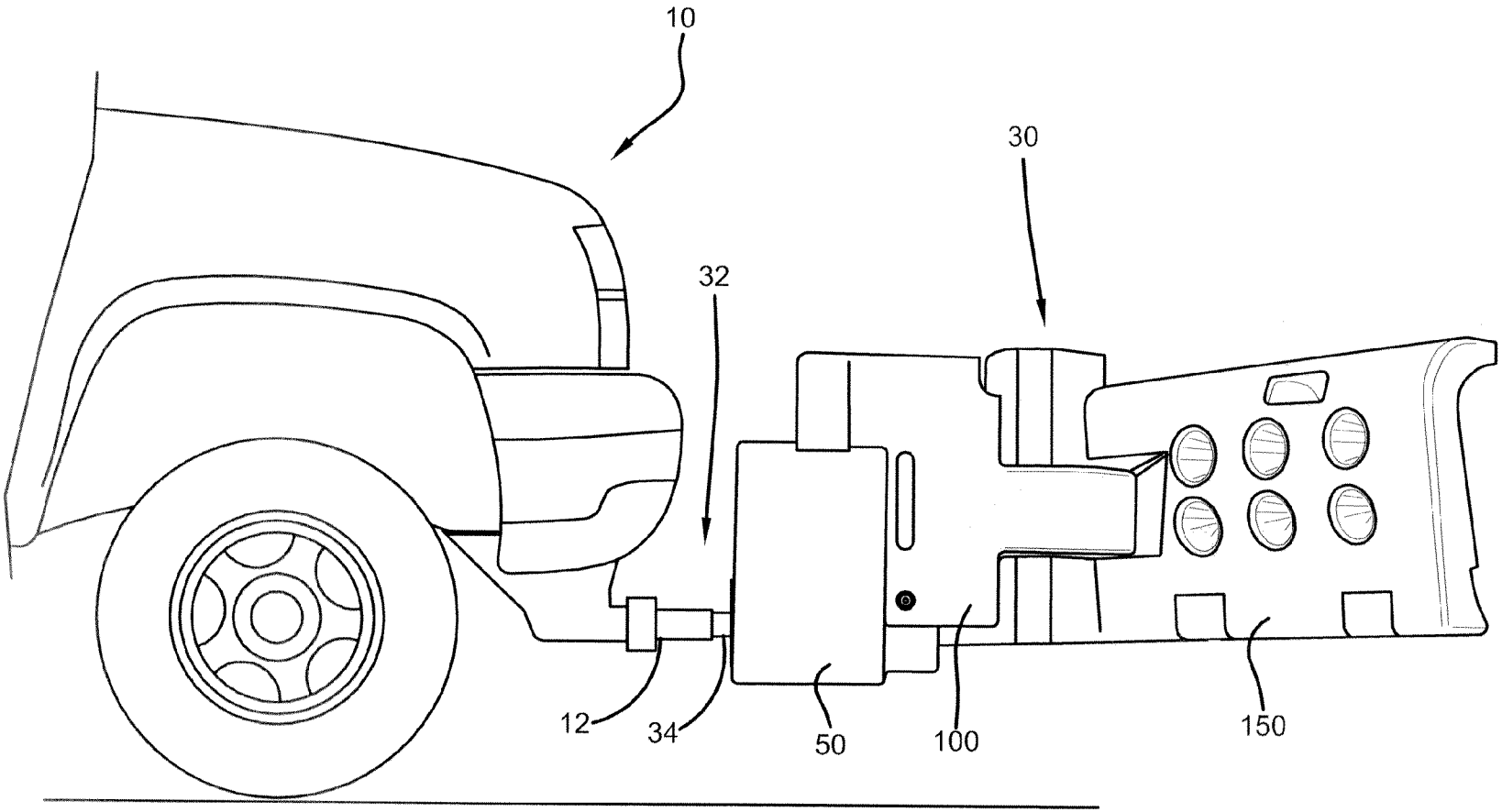
FIG. 1 is a side view of a vehicle equipped with a snowplow assembly according to one embodiment of this invention.
Figure 2:
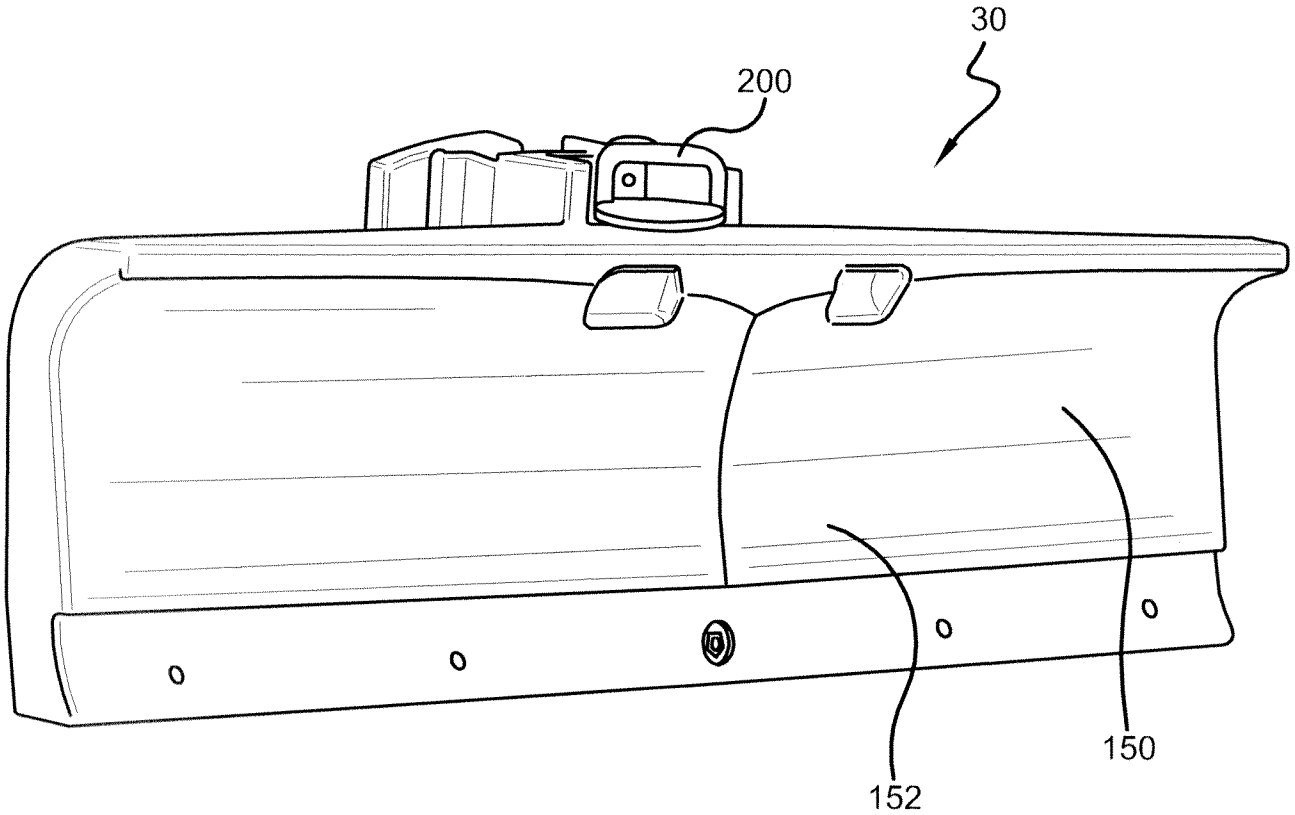
FIG. 2 is a front perspective view of the snowplow assembly shown in FIG. 1.
Figure 3:
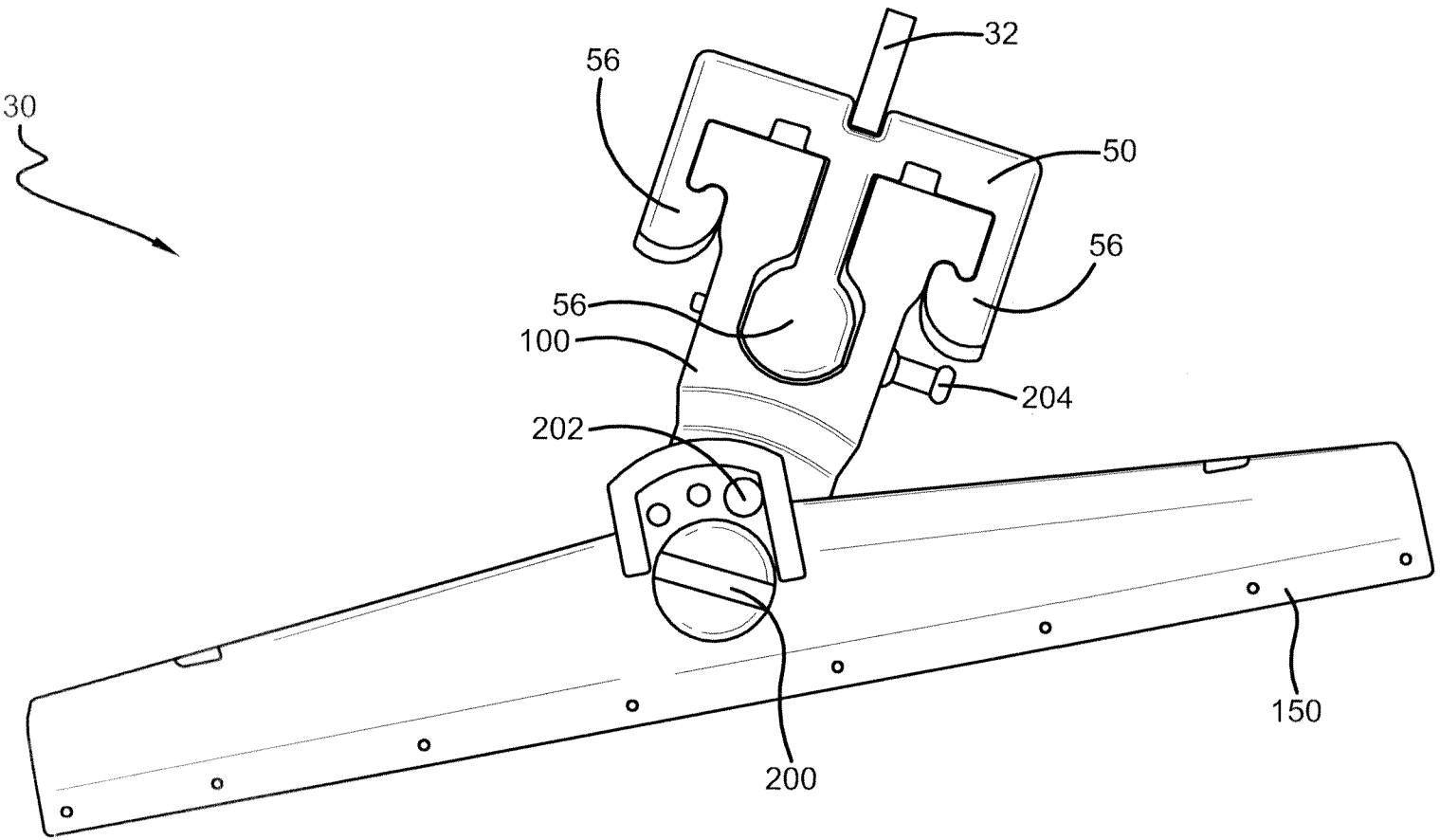
FIG. 3 is a top view of the snow plow assembly shown in FIG. 1.
Figure 4:
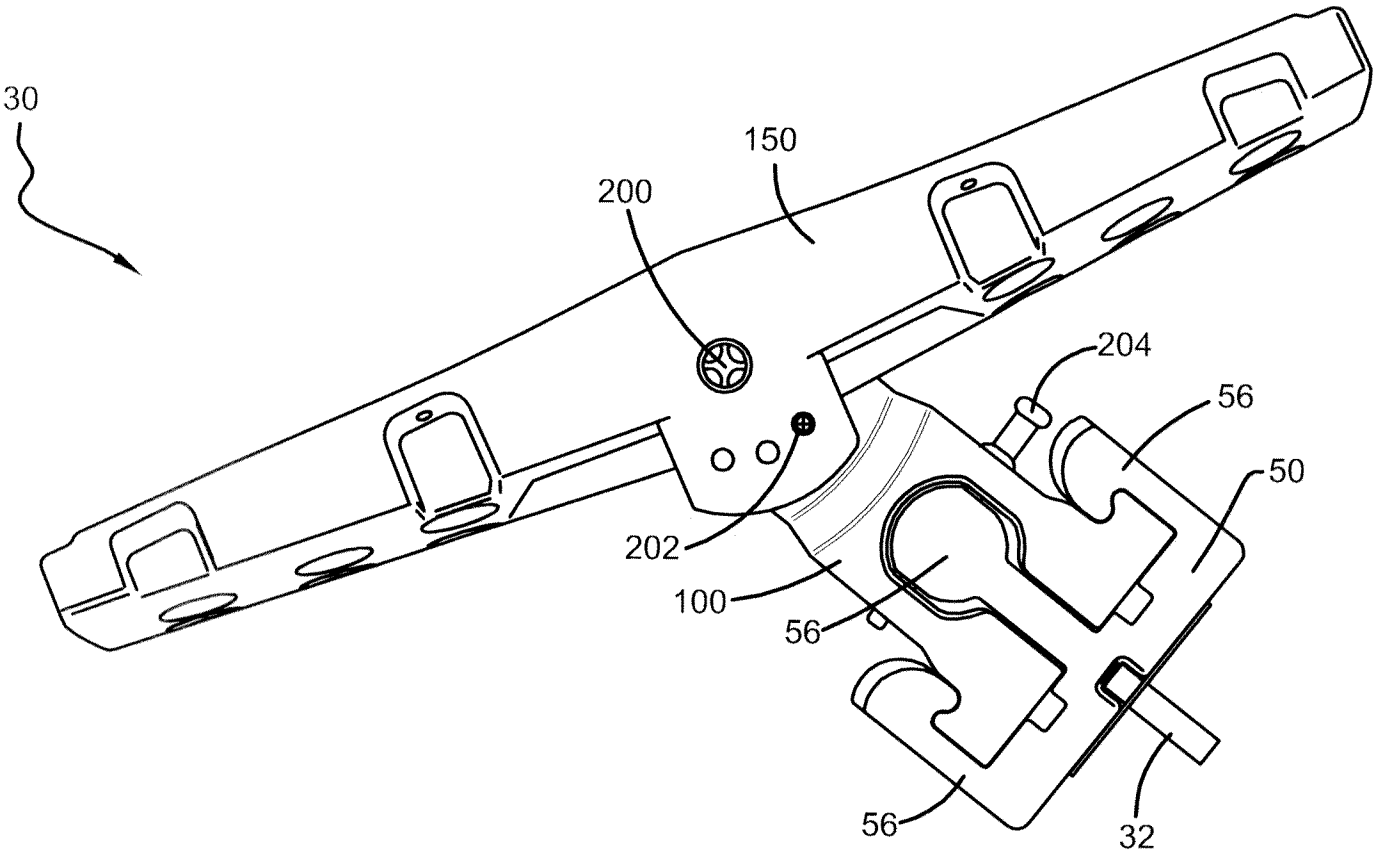
FIG. 4 is a bottom view of the snowplow assembly shown in FIG. 1.
Figure 5:
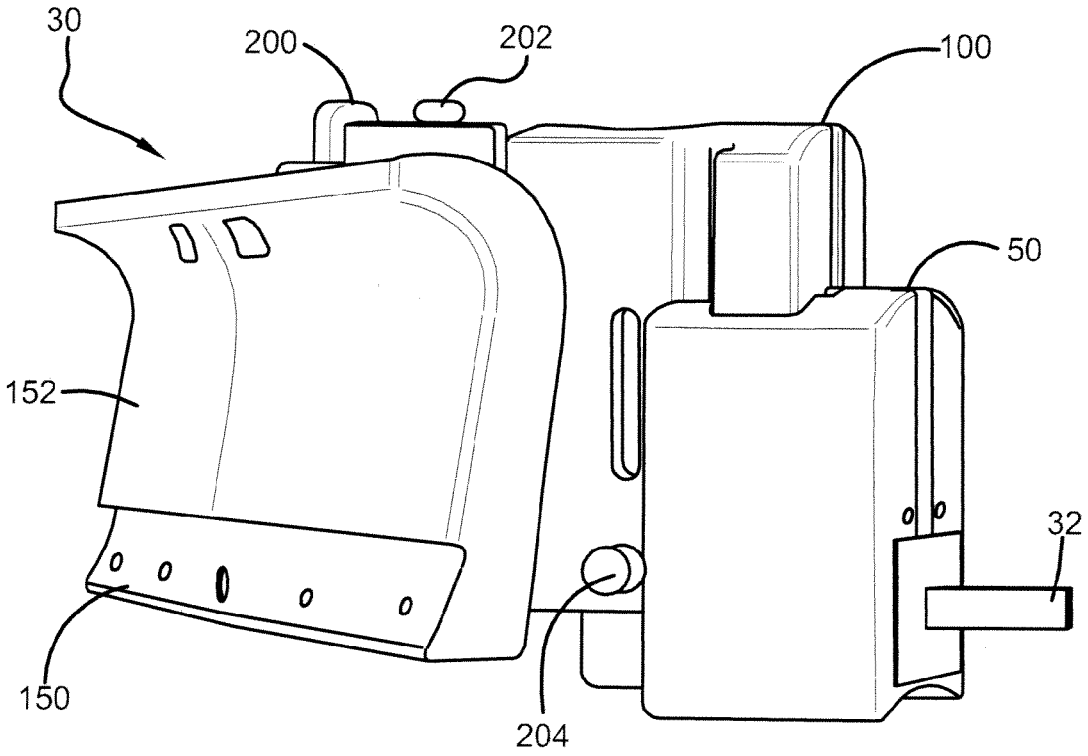
FIG. 5 is a left side view of the snowplow assembly shown in FIG. 1.
Figure 6:
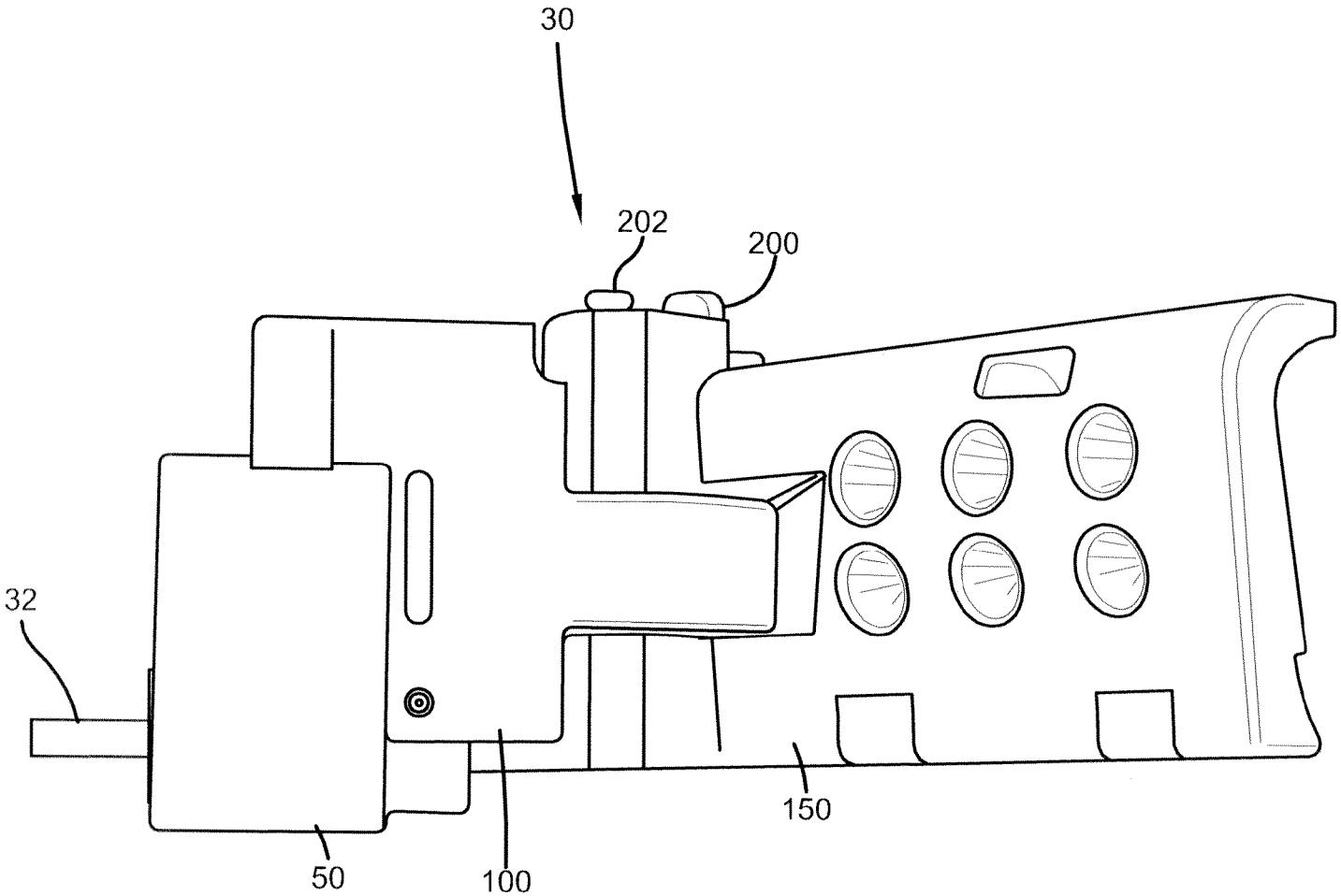
FIG. 6 is a right side view of the snowplow assembly shown in FIG. 1.
Figure 8:
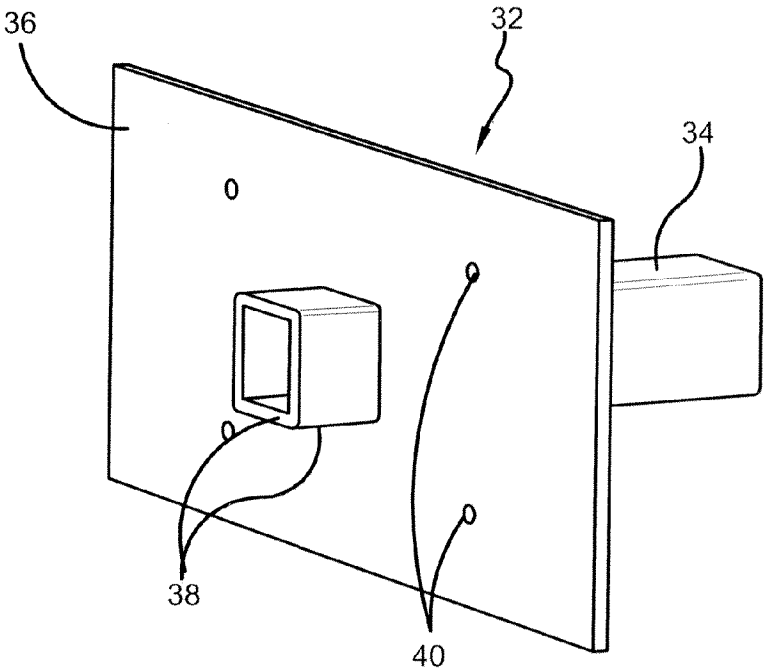
FIG. 8 is a back perspective view of the mounting member shown in FIG. 7.
Figure 7:
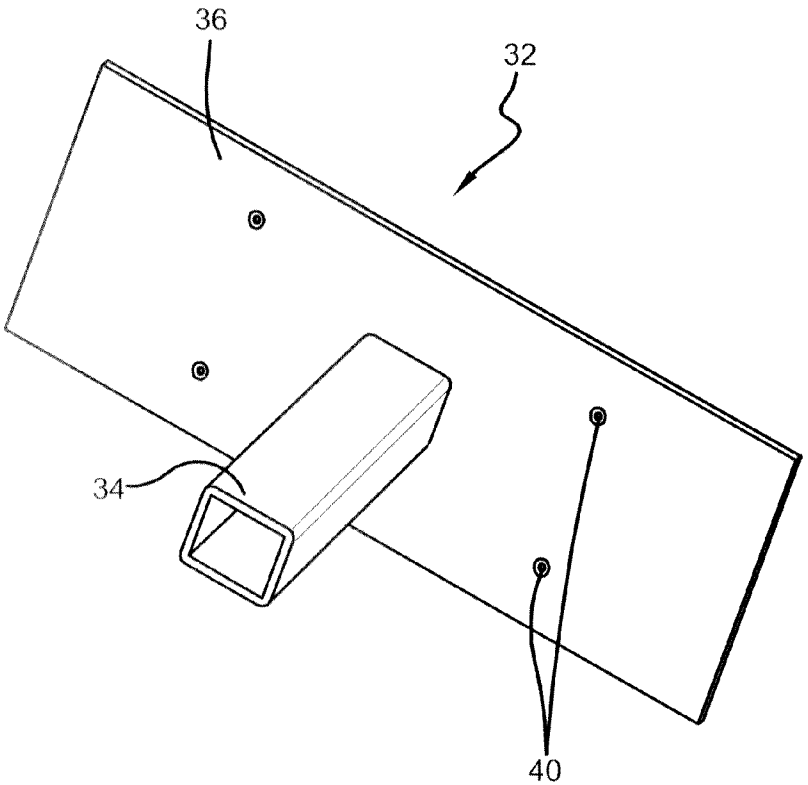
FIG. 7 is a front perspective view of a mounting member.
Figure 10:
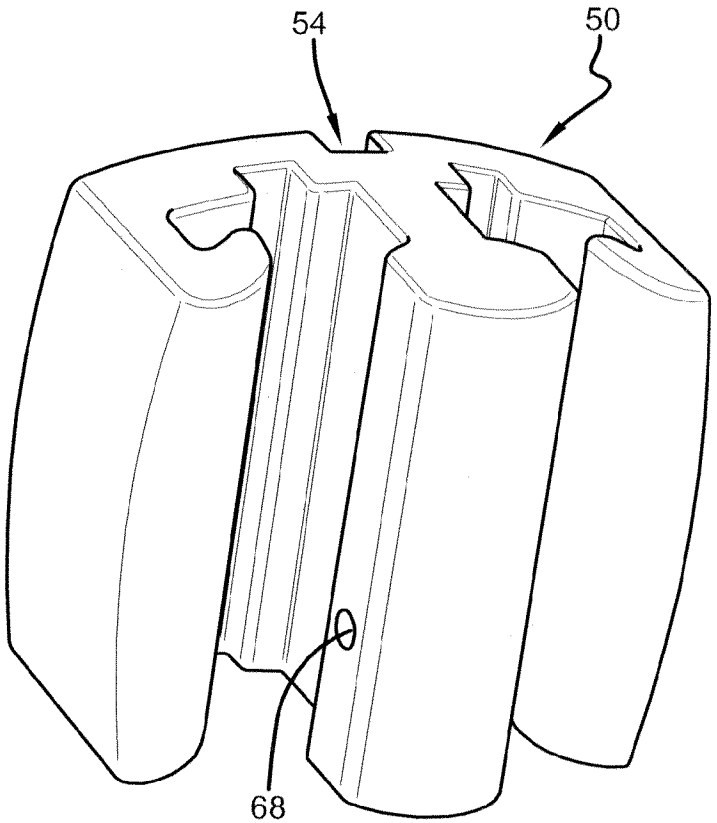
FIG. 10 is a front perspective view of the vehicle attachment component shown in FIG. 9.
Figure 9:
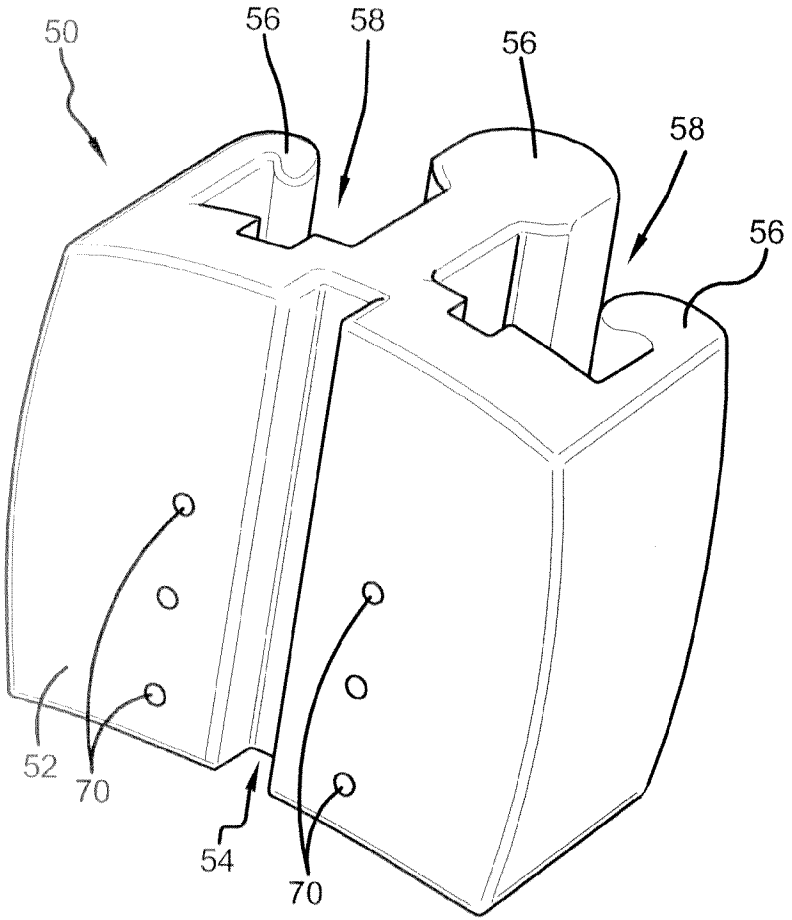
FIG. 9 is a back perspective view of a vehicle attachment component.
Figure 11:
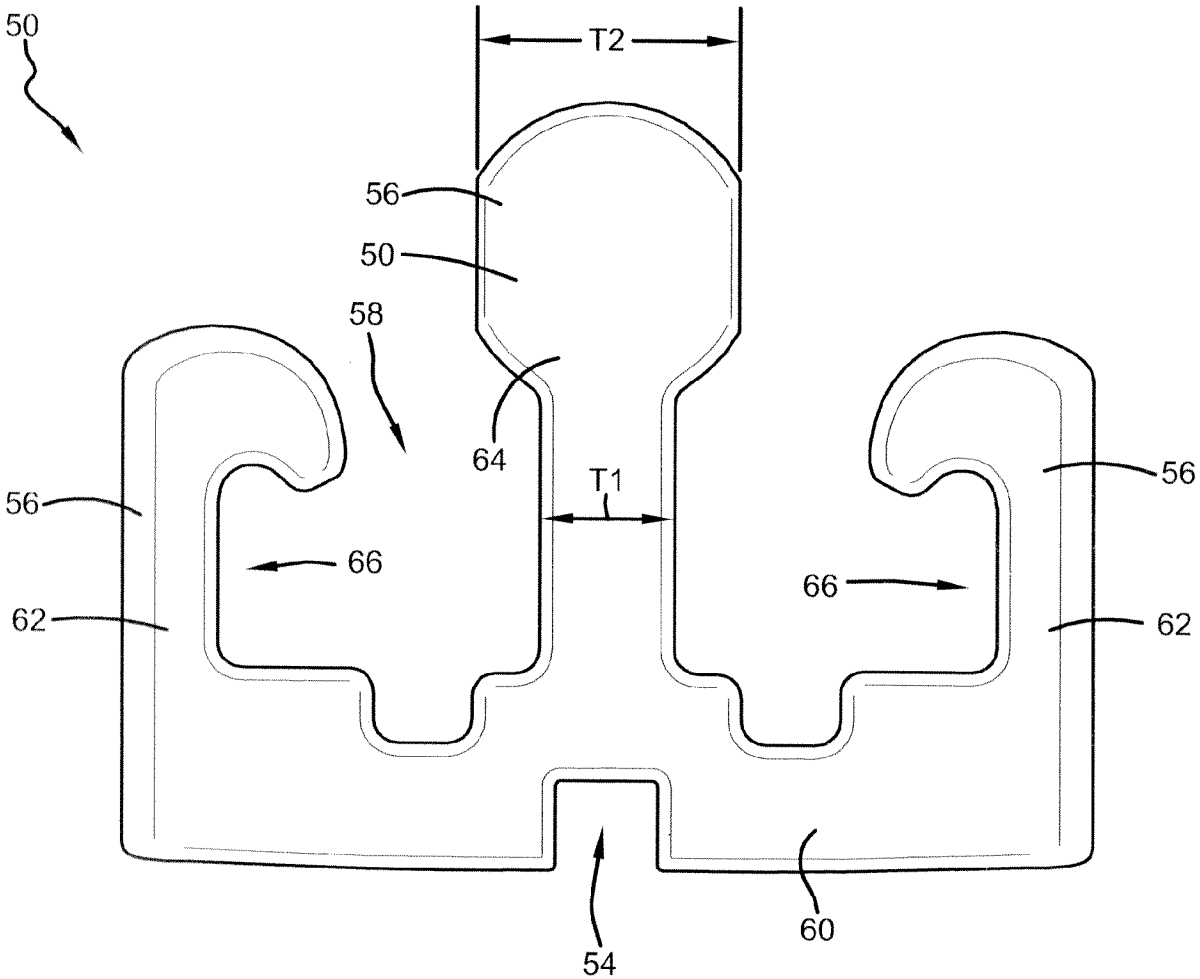
FIG. 11 is a top view of the vehicle attachment component shown in FIG. 9.
Figure 13:
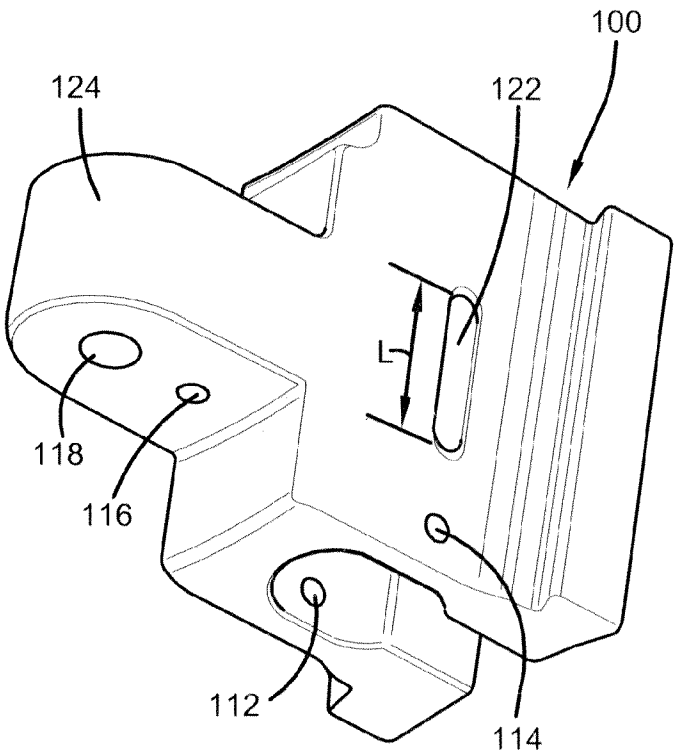
FIG. 13 is a left side perspective view of the blade support component shown in FIG. 12.
Figure 12:
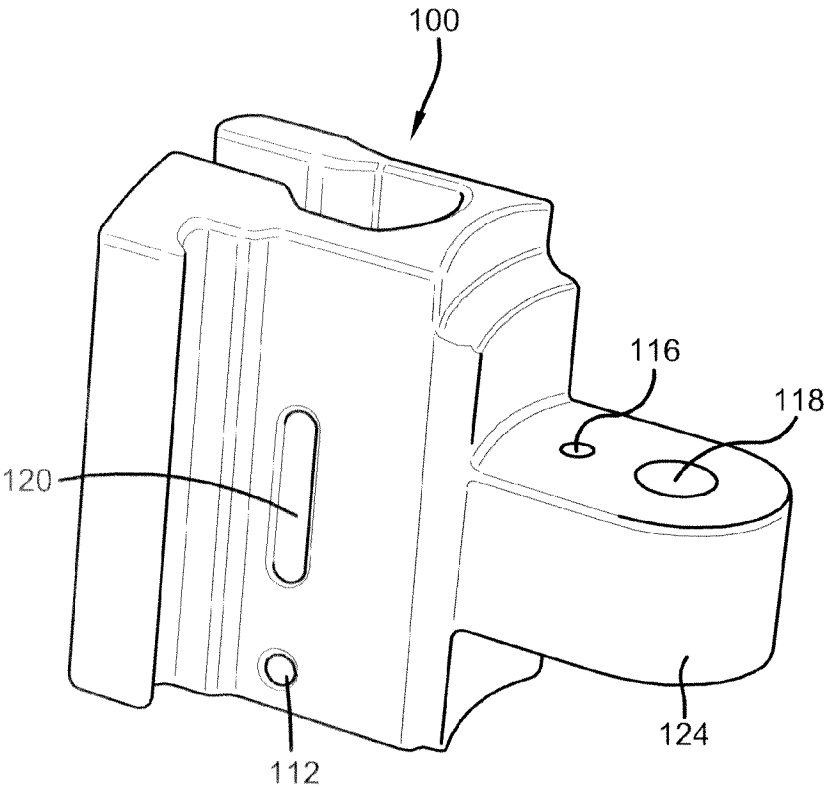
FIG. 12 is a right side perspective view of a blade support component.
Figure 14:
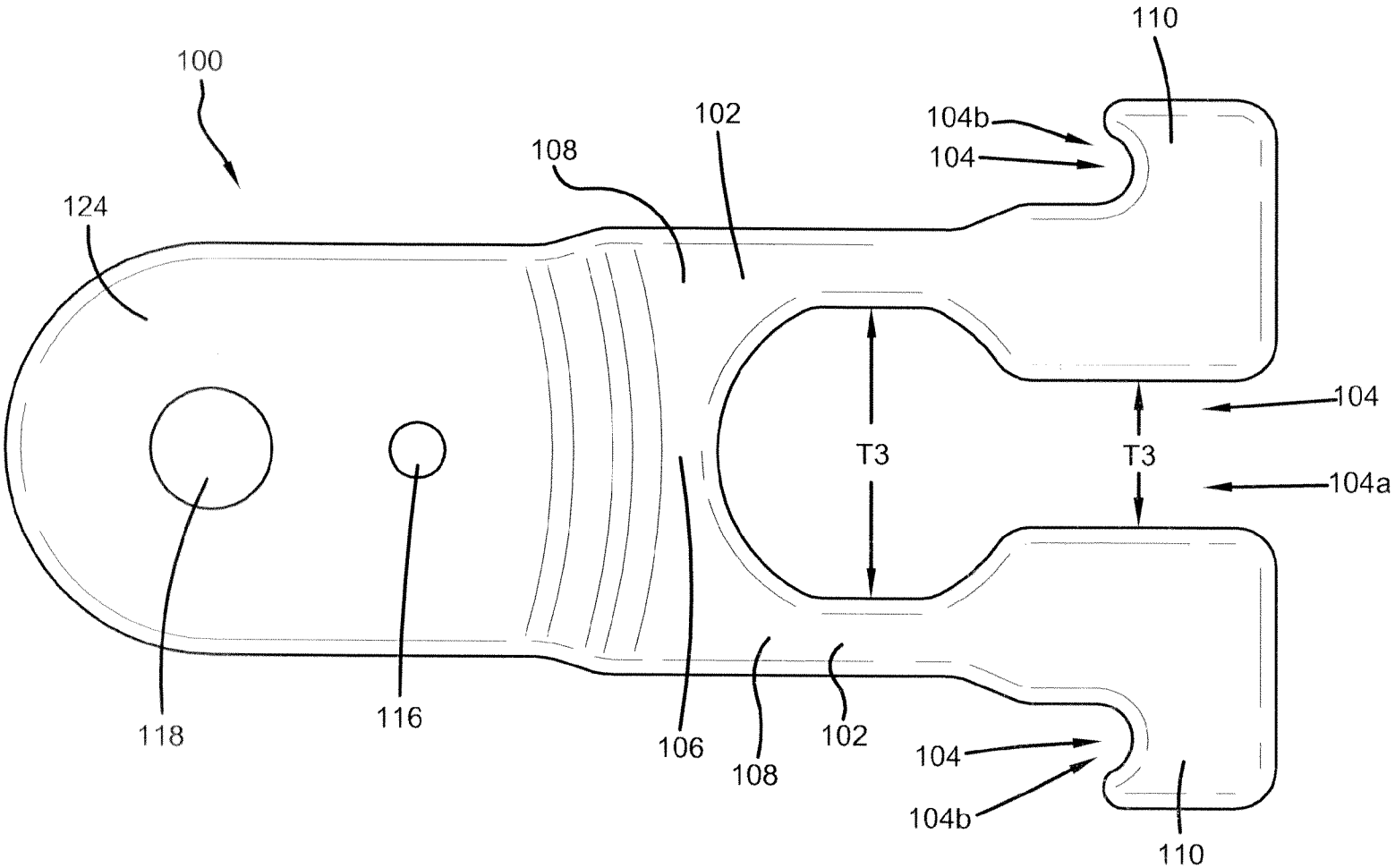
FIG. 14 is a top view of the blade support component shown in FIG. 12.
Figure 15:
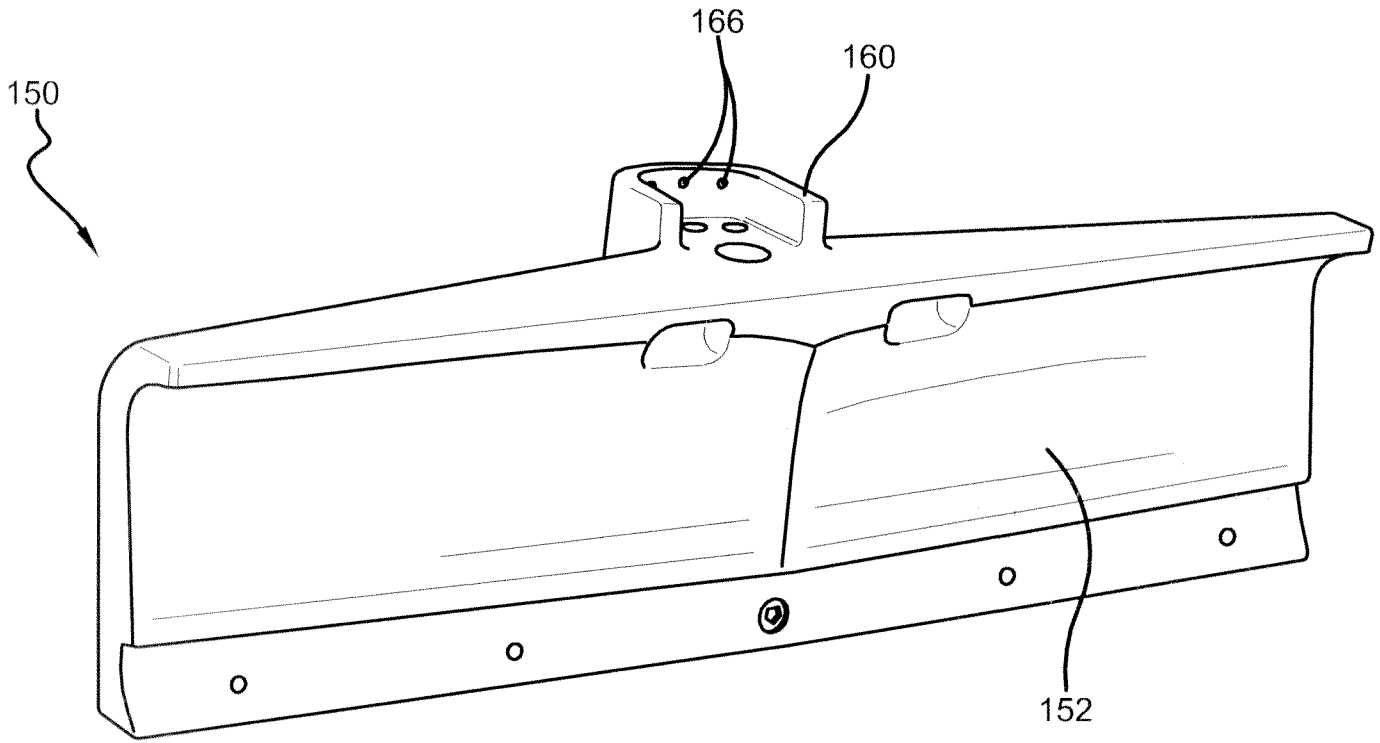
FIG. 15 is a front perspective view of a snowplow blade.
Figure 16:
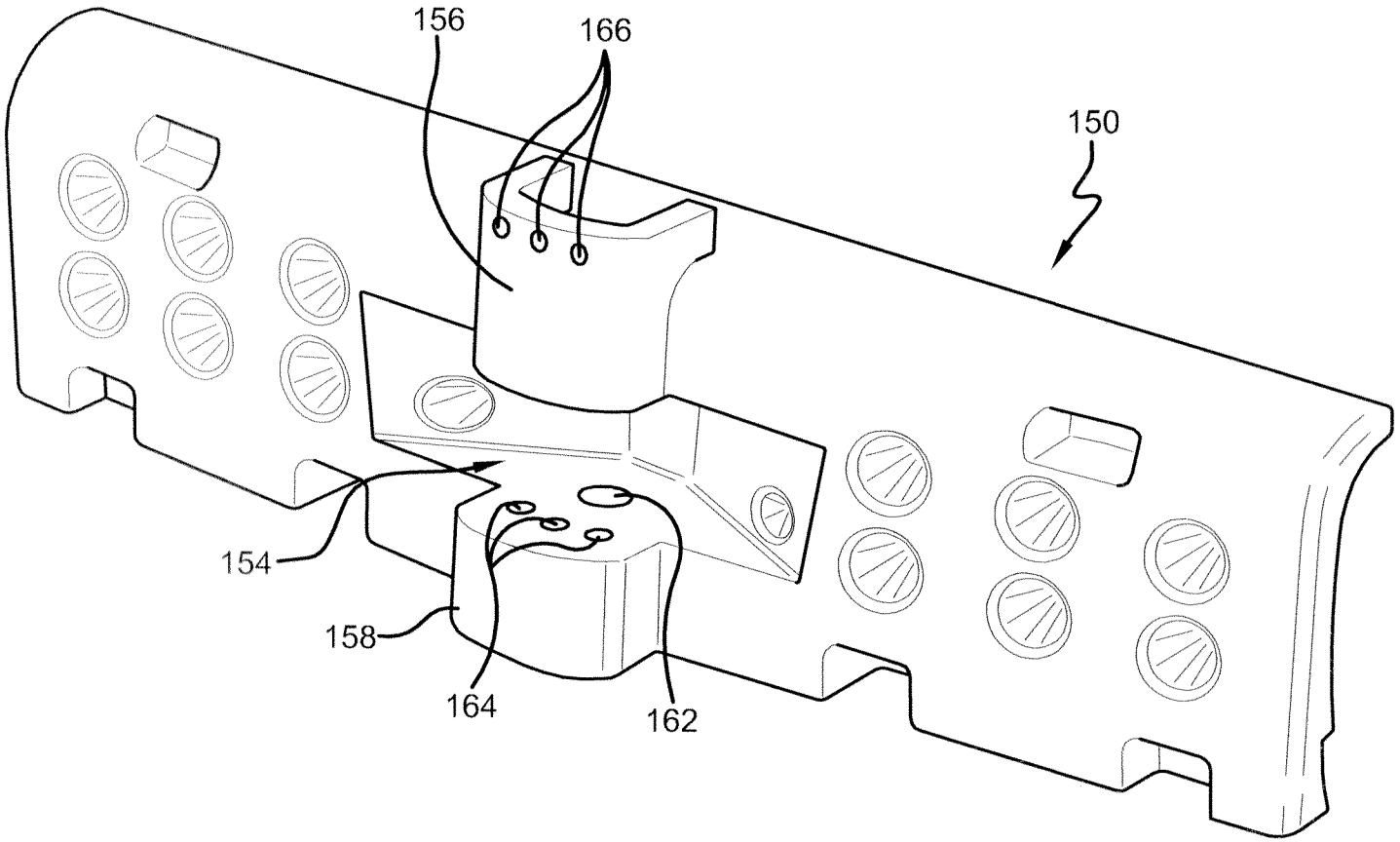
FIG. 16 is a back perspective view of the snowplow blade shown in FIG. 15.
Figure 17:
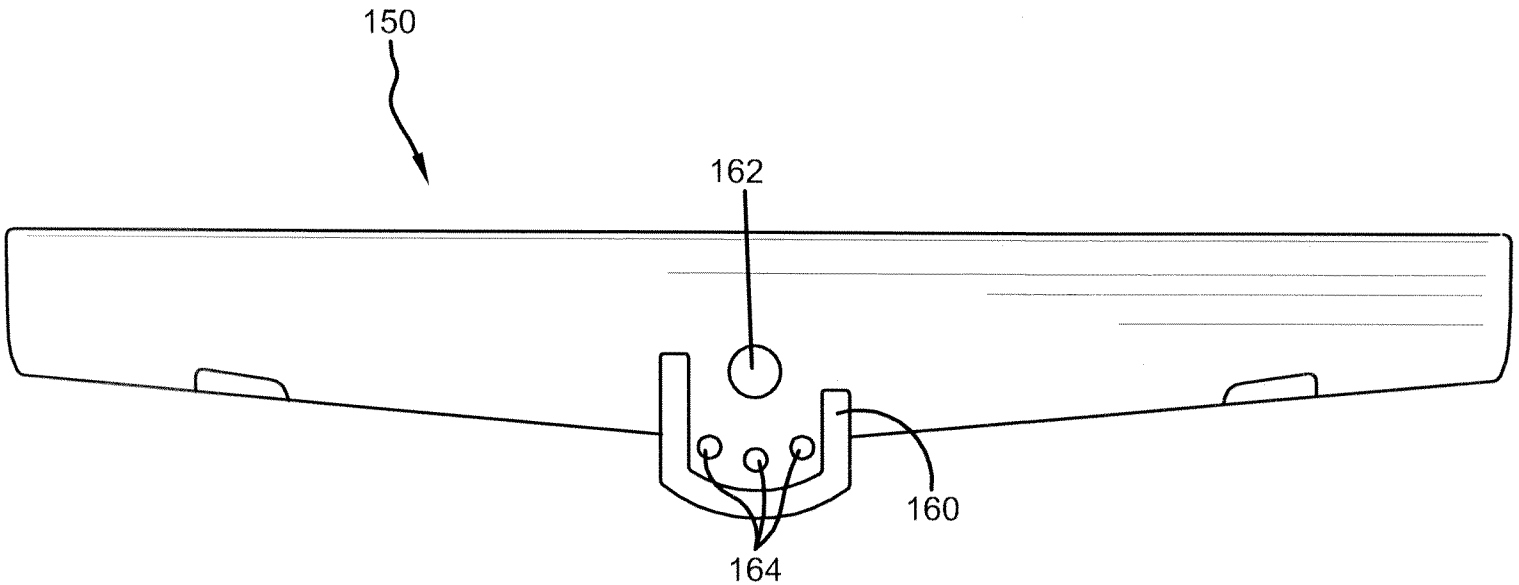
FIG. 17 is a top view of the snowplow blade shown in FIG. 15.
Figure 18:
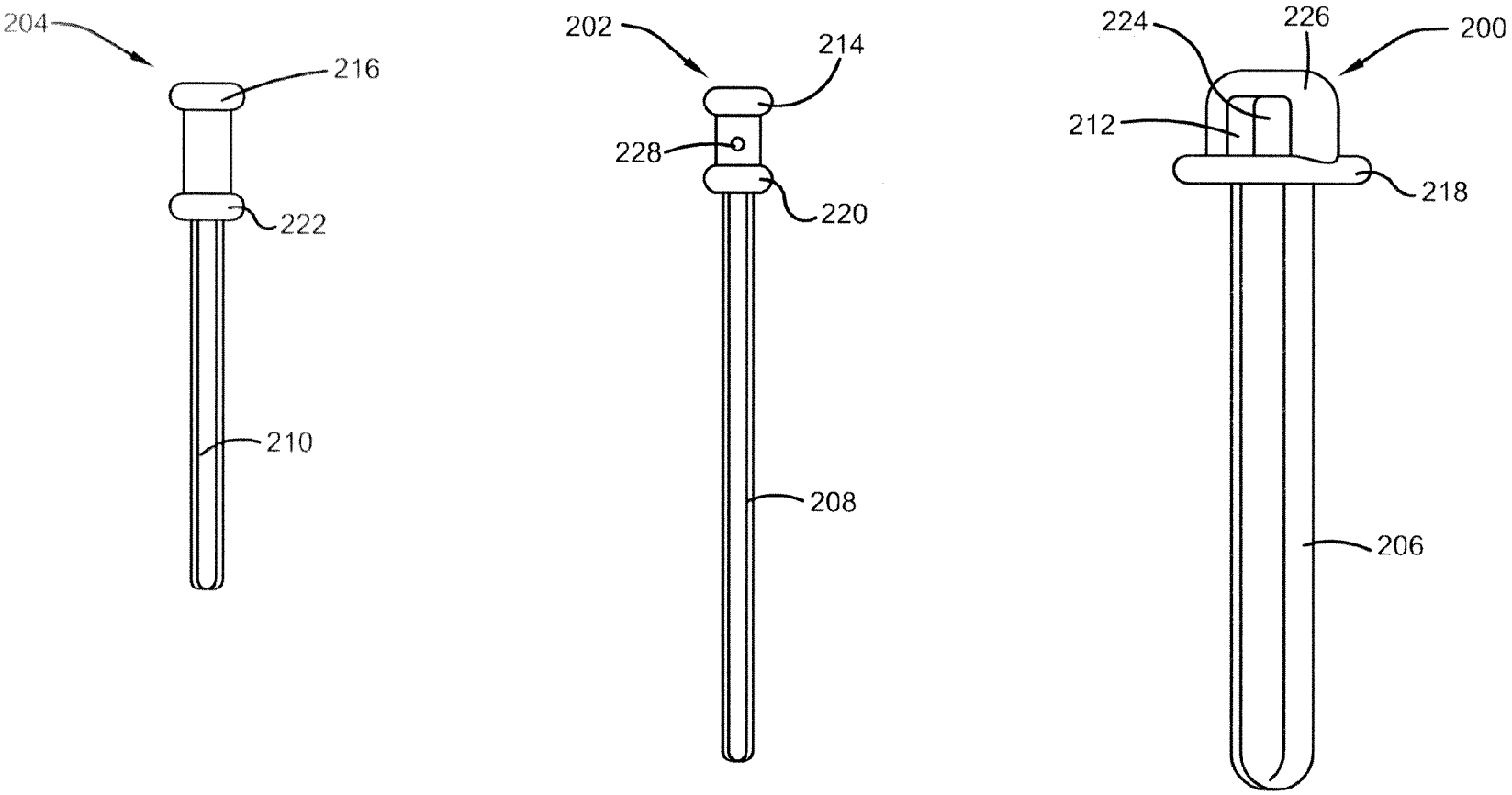
FIG. 18 is a side view of connection pins.
Figure 19:
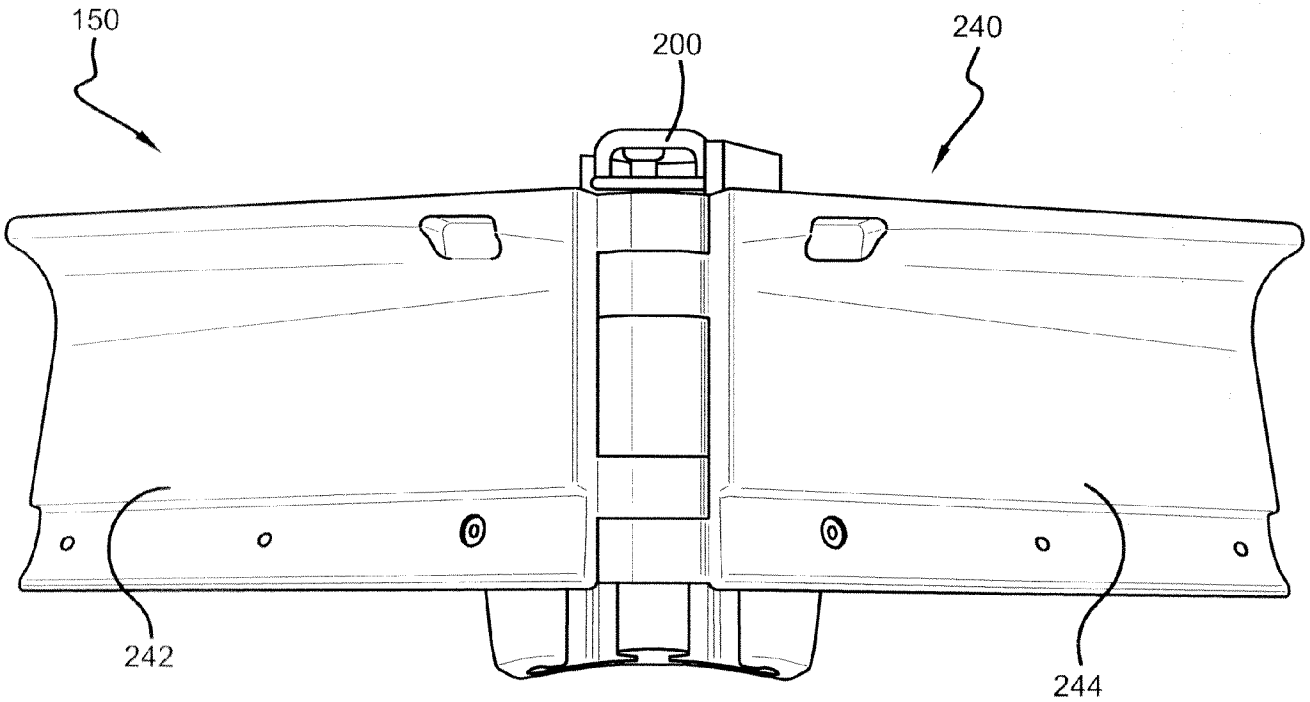
FIG. 19 is a front view of a snowplow assembly according to another embodiment of this invention.
Figure 20:
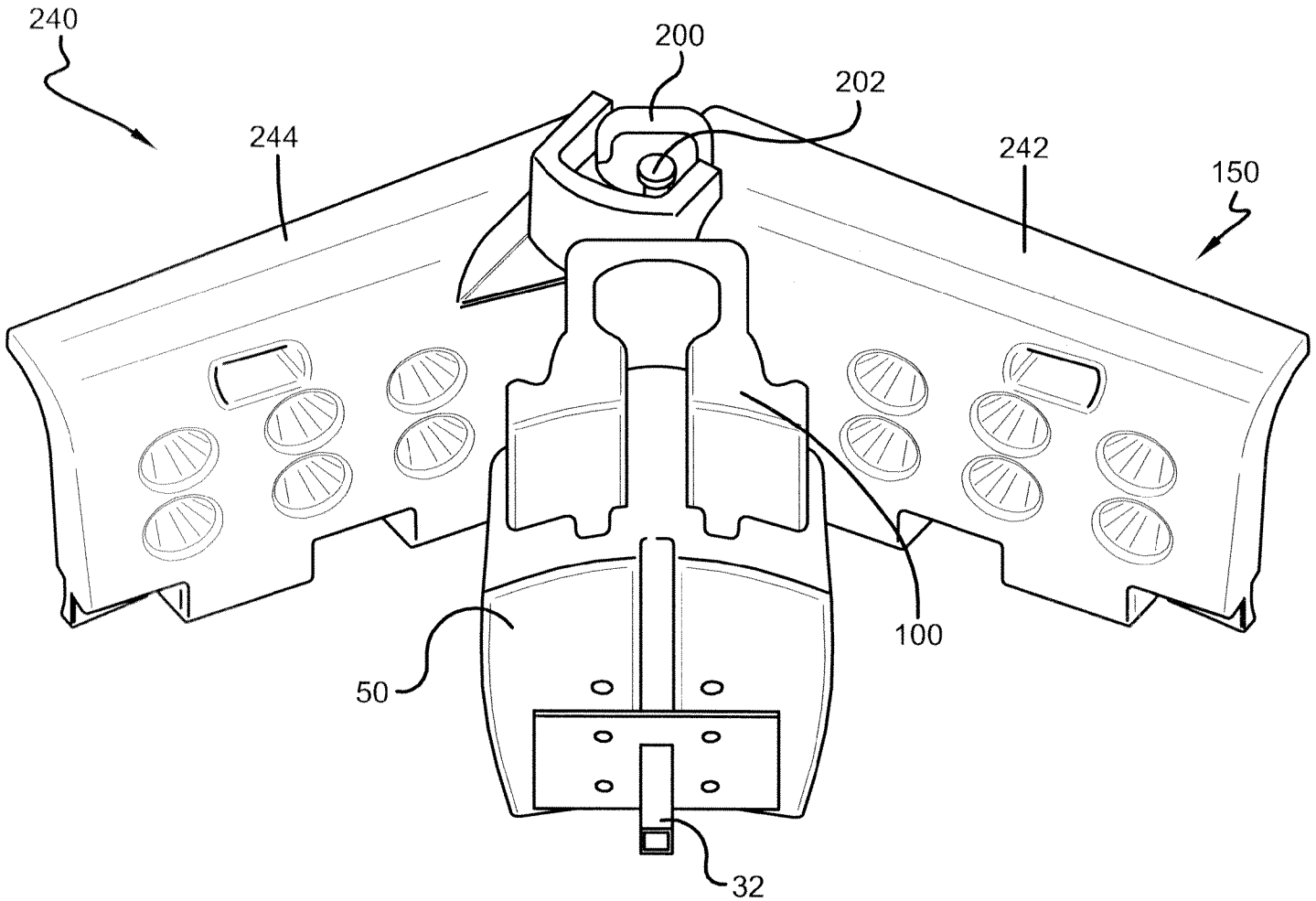
FIG. 20 is a back perspective view of the snowplow assembly shown in FIG. 19.

Referring now to the drawings wherein the showings are or purposes of illustrating embodiments of the invention only and not for purposes of limiting the same, and wherein like reference numerals are understood to refer to like components. FIG. 1 shows a vehicle 10 equipped with a snowplow assembly 30 according to some embodiments of this invention. It should be understood that the snowplow assembly 30 of this invention will work well with any vehicle chosen with the sound judgment of a person of skill in the art. While the snowplow assembly 30 may be attached to the vehicle 10 in any manner chosen with the sound judgment of a person of skill in the art, for the embodiment shown, the vehicle has a hitch 12 and the snowplow assembly 30 includes a mounting member 32 that includes a hitch mount 34 that extends from a plate 36. One or more connector openings 40 may be formed in the mounting member 32, such as in the plate 36 as shown. The mounting member 32 supports the snowplow assembly 30 to the vehicle 10. In one embodiment, the mounting member 32 is formed of a metal, such as steel. Because the snowplow assembly 30 is lightweight, as will be discussed further below, it is easy for the user to manually pick up the snowplow assembly 30 and insert the hitch mount 34 into the hitch 12 to mount the snowplow assembly 30 to the vehicle 10. In this patent, the term "manually" means a single typical human person can accomplish the activity without the aid of any tool, machine, or the like.

With reference now to FIGS. 1-6, the snowplow assembly 30 may include a vehicle attachment component 50, a blade support component 100, and a snowplow blade 150. In one embodiment, these components are hollow, that is, they have a void(s) or space(s) in their interiors. In one embodiment, these voids are empty (other than air). In another embodiment, these voids are filled with foam. By making the vehicle attachment component 50, the blade support component 100, and the snowplow blade 150 hollow, their weight is greatly reduced. In a specific embodiment, these components are formed in a rotational molding process. Because the rotational molding process is well known to those of skill in the art, further details will not be provided here.

In one embodiment, the vehicle attachment component 50 has an empty void(s) and its total weight is less than 50 pounds. In another embodiment, the vehicle attachment component 50 has an empty void(s) and its total weight is less than 40 pounds. In another embodiment, the vehicle attachment component 50 has an empty void(s) and its total weight is less than 30 pounds. In another embodiment, the vehicle attachment component 50 has an empty void(s) and its total weight is less than 25 pounds. In one specific embodiment, the vehicle attachment component 50 has an empty void(s) and its total weight is about 22 pounds. In one embodiment the void(s) is filled with foam, adding less than 10 pounds to the vehicle attachment component 50 weights noted above. In another embodiment, the void(s) is filled with foam, adding less than 5 pounds to the vehicle attachment component 50 weights noted above. In one specific embodiment, the void(s) is filled with foam, adding about 3 pounds to the vehicle attachment component 50 weights noted above.

In one embodiment, the blade support component 100 has an empty void(s) and its total weight is less than 50 pounds. In another embodiment, the blade support component 100 has an empty void(s) and its total weight is less than 40 pounds. In another embodiment, the blade support component 100 has an empty void(s) and its total weight is less than 30 pounds. In another embodiment, the blade support component 100 has an empty void(s) and its total weight is less than 25 pounds. In one specific embodiment, the blade support component 100 has an empty void(s) and its total weight is about 24 pounds. In one embodiment, the void(s) is filled with foam, adding less than 10 pounds to the blade support component 100 weights noted above. In another embodiment, the void(s) is filled with foam, adding less than 5 pounds to the blade support component 100 weights noted above. In one specific embodiment, the void(s) is filled with foam, adding about 4 pounds to the blade support component 100 weights noted above.

In one embodiment, the snowplow blade 150 has an empty void(s) and its total weight is less than 80 pounds. In another embodiment, the snowplow blade 150 has an empty void(s) and its total weight is less than 70 pounds. In another embodiment, the snowplow blade 150 has an empty void(s) and its total weight is less than 60 pounds. In another embodiment, the snowplow blade 150 has an empty void(s) and its total weight is less than 55 pounds. In one specific embodiment, the snowplow blade 150 has an empty void(s) and its total weight is about 54 pounds. In one embodiment, the void(s) is filled with foam, adding less than 20 pounds to the snowplow blade 150 weights noted above. In another embodiment, the void(s) is filled with foam, adding less than 15 pounds to the snowplow blade 150 weights noted above. In one specific embodiment, the void(s) is filled with foam, adding about 10 pounds to the snowplow blade 150 weights noted above.

In one embodiment, the vehicle attachment component 50, the blade support component 100 and the snowplow blade 150 all have empty voids and the total weight of the snowplow assembly 30 is less than 200 pounds. In another embodiment, the vehicle attachment component 50, the blade support component 100 and the snowplow blade 150 all have empty voids and the total weight of the snowplow assembly 30 is less than 190 pounds. In another embodiment, the vehicle attachment component 50, the blade support component 100 and the snowplow blade 150 all have empty voids and the total weight of the snowplow assembly 30 is less than 180 pounds.

In another embodiment, the vehicle attachment component 50, the blade support component 100 and the snowplow blade 150 all have empty voids and the total weight of the snowplow assembly 30 is less than 170 pounds. In another embodiment, the vehicle attachment component 50, the blade support component 100 and the snowplow blade 150 all have empty voids and the total weight of the snowplow assembly 30 is less than 160 pounds. In another embodiment, the vehicle attachment component 50, the blade support component 100 and the snowplow blade 150 all have empty voids and the total weight of the snowplow assembly 30 is less than 150 pounds. In another embodiment, the vehicle attachment component 50, the blade support component 100 and the snowplow blade 150 all have empty voids and the total weight of the snowplow assembly 30 is less than 140 pounds. In another embodiment, the vehicle attachment component 50, the blade support component 100 and the snowplow blade 150 all have empty voids and the total weight of the snowplow assembly 30 is less than 130 pounds. In another embodiment, the vehicle attachment component 50, the blade support component 100 and the snowplow blade 150 all have empty voids and the total weight of the snowplow assembly 30 is less than 120 pounds. In another embodiment, the vehicle attachment component 50, the blade support component 100 and the snowplow blade 150 all have empty voids and the total weight of the snowplow assembly 30 is less than 110 pounds. In another embodiment, the vehicle attachment component 50, the blade support component 100 and the snowplow blade 150 all have empty voids and the total weight of the snowplow assembly 30 is about 100 pounds.

In one embodiment, the vehicle attachment component 50, the blade support component 100 and the snowplow blade 150 all have voids filed with foam and the total weight of the snowplow assembly 30 is less than 200 pounds. In another embodiment, the vehicle attachment component 50, the blade support component 100 and the snowplow blade 150 all have voids filed with foam and the total weight of the snowplow assembly 30 is less than 190 pounds. In another embodiment, the vehicle attachment component 50, the blade support component 100 and the snowplow blade 150 all have voids filed with foam and the total weight of the snowplow assembly 30 is less than 180 pounds. In another embodiment, the vehicle attachment component 50, the blade support component 100 and the snowplow blade 150 all have voids filed with foam and the total weight of the snowplow assembly 30 is less than 170 pounds. In another embodiment, the vehicle attachment component 50, the blade support component 100 and the snowplow blade 150 all have voids filed with foam and the total weight of the snowplow assembly 30 is less than 160 pounds. In another embodiment, the vehicle attachment component 50, the blade support component 100 and the snowplow blade 150 all have voids filed with foam and the total weight of the snowplow assembly 30 is less than 150 pounds.

In another embodiment, the vehicle attachment component 50, the blade support component 100 and the snowplow blade 150 all have voids filed with foam and the total weight of the snowplow assembly 30 is less than 140 pounds. In another embodiment, the vehicle attachment component 50, the blade support component 100 and the snowplow blade 150 all have voids filed with foam and the total weight of the snowplow assembly 30 is less than 130 pounds. In another embodiment, the vehicle attachment component 50, the blade support component 100 and the snowplow blade 150 all have voids filed with foam and the total weight of the snowplow assembly 30 is less than 120 pounds. It should be understood, that combinations of components having empty voids and voids filled with foam are also contemplated.

With reference now to FIGS. 1 and 3-11, the vehicle attachment component 50 may have a surface 52 to which the mounting member 32 is attached. For the embodiment shown, the surface 52 is on a rear face of the vehicle attachment component 50. The surface 52 may have one or more connector openings 70 that are aligned with the connector openings 40 formed in the mounting member 32. One or more connectors, not shown, may then be inserted into the connector openings 40, 70 to attach the mounting member 32 to the vehicle attachment component 50 in a known manner. In one embodiment, shown, the surface 52 has a groove 54. The groove 54 may be in the lateral center of the surface 52 and may receive an extension 38 of the mounting member 32 to make the side-to-side centering of the mounting member 32 to the attachment component 50 very easy to achieve. The groove 54 may extend vertically, as shown, to provide position adjustment of the mounting member 32 relative to the attachment component 50, and thus height adjustment of the snow plow assembly 30 with respect the vehicle 10.

With reference now to FIGS. 3-4 and 9-11, the vehicle attachment component 50 may have at least one arm 56, three arms 56 shown, and at least one channel 58, two channels 58 shown. The arms may have the same length or one arm, inner arm 56 shown, may be longer that the other(s). In one embodiment, shown, each channel 58 is formed between two arms 56, 56. The vehicle attachment component 50 may be shaped and sized in any manner chosen by a person of skill in the art. For the embodiment shown, the vehicle attachment component 50 has an E-shaped cross-section, when viewed from above or below, defining a base 60, first and second outer limbs 62, 62 and an inner limb 64. With this arrangement, the three limbs 62, 62, 64 define the three arms 56, 56, 56. This arrangement also provides that the surface 52 is positioned on the base 60. At least one of the arms, for the embodiment show, inner arm 56, may have a proximal end with a thickness T1 and a distal end with a thickness T2 that is greater than T1. At least one of the arms, for the embodiment shown, both outer arms 56, 56, may have a groove 66. For the embodiment shown, each groove 66 is formed on an inner surface of an outer arm 56. The attachment component 50 may also have a hole 68 for purposes to be discussed further below. In one embodiment, the hole 68 is formed in one of the arms 56. For the embodiment shown, the hole 68 is formed in the inner arm 56. In a more specific embodiment, also shown, the hole 68 may be formed in the portion of the arm having thickness T2. In another embodiment, the hole 68 may extend through the arm 56 in which it is formed.

With reference now to FIGS. 1, 3-6 and 12-14, the blade support component 100 may have at least one arm 102, two arms 102 shown, and at least one channel 104, three channels 104 shown. The arms may have the same length, as shown, or one arm may be longer that the other. A ridge 110 may extend from each arm 102. For the embodiment shown, the ridges 110, 110 extend outward from distal ends of the arms 102, 102. In one embodiment shown, one channel 104*a* is formed between arms 102, 102 and the other two channels 104*b*, 104*b* are formed on the arms 102, 102. The channel 104*a* may have a proximal end with a thickness T3 and a distal end with a thickness T4 that is less than T3. The channels 104*b*, 104*b* may be formed on outer surfaces of the arms 102, 102, as shown The blade support component 100 may be shaped and sized in any manner chosen by a person of skill in the art. For the embodiment shown, blade support component 100 has a C-shaped cross-section, when viewed from above or below, defining a base 106, first and second outer limbs 108, 108. With this arrangement, the two limbs 108, 108 define the two arms 102, 102.

With continuing reference to FIGS. 1, 3-6 and 12-14, the blade support component 100 may have holes, 112, 114, 116, opening 118 and slots 120, 122. These holes, opening and slots may be numbered, sized and located as chosen by a person of skill in the art. In one embodiment, shown, the opening 118 has a larger diameter than the holes 112, 114 and the slots 120, 122 have a thickness substantially equal to the diameter of the holes 112, 114. The slots 120, 122 may have a length L that is chosen to provide the desired float height adjustment range, as will be discussed further below. For the embodiment shown, holes 112, 114 and slots 120, 122 are formed, respectively, in the arms 102, 102. In a more specific embodiment, the holes 112, 114 and slots 120, 122 may extend through the arms 102, 102, as shown. In one embodiment, the hole 116 and opening 118 may be formed in an extension member 124. In a more specific embodiment, the hole 116 and opening 118 may extend through the extension member 124, as shown. For the embodiment shown, the extension member 124 extends from the base 106 in a direction substantially opposite the arms 102, 102. The hole 116 may be positioned relatively inward when compared to the opening 118, as shown.

With reference now to FIGS. 1-6 and 15-17, the snowplow blade 150 may have a snow contact surface 152 designed to contact and plow associated snow, ice and the like. While the snowplow blade 150 shown is considered a "straight blade" in that the snow contact surface 152 is substantially planar in the lateral direction, it should be understood that any shape, type and size of snowplow blade chosen with the sound judgment of a person of skill in the art may be used with this invention. The snowplow blade 150 may have a cavity 154 positioned behind the snow contact surface 152, in a rear surface, as shown. An upper portion 156 of the snowplow blade 150 may extend above the cavity 154 and a lower portion 158 may extend below the cavity 154, as shown. A wall 160 may extend upward from the upper portion 156 and may serve to protect latter to be described pins. The wall 160 may have one or more apertures 166, three shown, used for a purpose discussed below.

With continue reference to FIGS. 1-6 and 15-17, the snowplow blade 150 may have at least one opening 162, two openings 162 shown, and at least one hole 164, six holes 164 shown. The number, location and size of the openings and holes can be any chosen by a person of skill in the art. In one embodiment, there are an opening 162 and three holes 164, 164, 164 formed in the upper portion 156 and another opening 162 and three other holes 164, 164, 164 formed in the lower portion 158. The openings and pairs of holes may be collinear, as shown. In a more specific embodiment, shown, the openings 162 and holes 164 may extend through the upper and lower portions 156, 158. The holes 164 may be positioned along an arc, as shown, for reasons to be described below. The openings 162 may be positioned relatively inward when compared to the holes 164, as shown. In one embodiment, shown, the openings 162 have larger diameters than the holes 164.

With reference now to FIGS. 2-5 and 18, the snowplow assembly 30 may include connection pins 200, 202, 204 that may be sized and shaped in any manner chosen by a person of skill in the art. Each pin 200, 202, 204 may include a shaft 206, 208, 210 and a handle 212, 214, 216. The shaft 206 of connection pin 200 may be sized to be manually received in and manually removed from the openings 162 in the snowplow blade 150 and the opening 118 in the blade support component 100. The operator may grip the handle 212, 214, 216 of each connection pin when being manually adjusted. The shaft 208 of connection pin 202 may be sized to be manually received in and manually removed from the holes 164 in the snowplow blade 150 and the hole 116 in the blade support component 100. The shaft 210 of connection pin 204 may be sized to be manually received in and manually removed from the holes 112, 114 and slots 120, 122 in the blade support component 100 and the hole 68 in the vehicle attachment component 50. Each connection pin 200, 202, 204 may have a collar 218, 220, 222 that extends outward beyond the corresponding shaft 206, 208, 210 and thus limits how far the corresponding connection pin can be inserted into the corresponding openings and holes. The handle 212 of connection pin 200 may include an aperture 224 defining a grip surface 226 that is easy for the operator to grip when inserting and removing the connection pin 200. The handle 214 of connection pin 202 may have an aperture 214 that receives a locking pin (not shown) that may be extended through the corresponding aperture 166 in the wall 160 of the snowplow blade 150 and into the aperture 214 to maintain the connection pin 202 in the desired position.

With reference now to FIGS. 1-15, the assembly and use of the snowplow assembly 30 will now be described. The mounting member 32 may be attached to the vehicle attachment component 50. In one embodiment, this is done by inserting the extension 38 into the groove 54, moving the extension 38 (and thus the entire mounting member 32) within the groove 54 until the desired relative position is achieved, aligning corresponding connector openings 40, 70 and then inserting connectors (not shown). The vehicle attachment component 50 may then be manually attached to the vehicle 10. In one embodiment, this is done by manually inserting the hitch mount 34 into (or over) the hitch 12 of the vehicle 10. Any manner of attaching the vehicle attachment component 50 to the vehicle 10 chosen with the sound judgment of a person of skill in the art will work with this invention.

The snowplow blade 150 may then be manually attached to the blade support component 100. In one embodiment, this is done by manually inserting the extension member 124 of the blade support component 100 into the cavity 154 of the snowplow blade 150, as shown. The connection pin 200 may then be manually inserted into at least one of the openings 162 in the snowplow blade 150 and into the opening 118 in the blade support component 100. This arrangement provides for easy relative rotation of the snowplow blade 150 about the connection pin 200 with respect to the blade support component 100 as will be discussed below.

With continuing reference to FIGS. 1-17, the blade support component 100 may then be manually attached to the vehicle attachment component 50. In one embodiment, this is done by manually inserting one or more of the arms 56 of the vehicle attachment component 50 within one or more of the channels 104 of the blade support component 100 and one or more of the arms 102 of the blade support component 100 within one or more of the channels 58 of the vehicle attachment component 50, as shown. In one specific embodiment, during this step the distal end of the arm 56 having thickness T2 may be received within the proximal end of the channel 104 having thickness T3 and the proximal end of the arm 56 having thickness T1 may be received within the distal end of the channel 104 having thickness T4. For the embodiment shown, T2 is not greater than T3, T1 is not greater than T4 and T2 is greater than T4. In another embodiment, during this step the ridges 110 of the blade support component 100 may be received in the grooves 66 of the vehicle attachment component 50, as shown. These arrangements provide for easy relative vertical sliding motion between the blade support component 100 and the vehicle attachment component 50 while maintaining their relative positions in all other directions as will be discussed further below.

It should be noted that while the method of assembling the snowplow assembly 30 just described suggests the order of: (1) manually attaching the vehicle attachment component 50 to the vehicle 10; then, (2) manually attaching the snowplow blade 150 to the blade support component 100; and then, (3) manually attaching the blade support component 100 (along with the snowplow blade 150) to the vehicle attachment component 50, any order chosen with the sound judgment of a person of skill in the art may be used. The operator may instead first (1) manually attach the vehicle attachment component 50 to the vehicle 10; then, (2) manually attach the blade support component to the vehicle attachment component 50; and then, (3) manually attaching the snowplow blade 150 to the blade support component 100. Because the snowplow assembly 30 of this invention is so light, the operator could alternatively first attach the vehicle attachment component 50, blade support component 100 and snowplow blade 150 together, and then attach the snowplow assembly 30 altogether to the vehicle 10.

Still referring to FIGS. 1-15, the snowplow blade 150 may then be manually positioned to an above snowplow operation height (meaning the snowplow blade 150 is too high off the ground surface to properly plow snow but ideally positioned to transport the snowplow assembly 30 via the vehicle 10 to another location) by first manually sliding the blade support component 100 upward with respect to the vehicle attachment component 50 (by sliding the arm(s) 56 relative to the channel(s) 104 and the arm(s) 102 relative to the channel(s) 54) until at least one of the hoes 112, 114 in the blade support component 100 is aligned with the hole 68 in the vehicle attachment component 50 and then manually inserting the connection pin 204 into the holes 112 and/or 114 and 68.

The snowplow blade 150 may then be manually positioned to a snowplow operation height (meaning the snowplow blade 150 is properly positioned relative to the ground surface to plow snow) by manually removing the connection pin 204 from at least one of the holes 112, 114, 68 and then allowing gravity to lower the blade support component 100 with respect to the vehicle attachment component 50 to the ground surface (by sliding the arm(s) 56 relative to the channel(s) 104 and the arm(s) 102 relative to the channel(s) 54).

With continuing reference to FIGS. 1-15, if the blade support component 100 includes at least one slot 120, 122, the snowplow blade 150 may be manually placed into a "float mode" (meaning the snowplow blade 150 is free to move up and down along with the ground surface terrain) by first manually sliding the blade support component 100 with respect to the vehicle attachment component 50 (by sliding the arm(s) 56 relative to the channel(s) 104 and the arm(s) 102 relative to the channel(s) 54) until at least one of the slots 120, 122 in the blade support component 100 is aligned with the hole 68 in the vehicle attachment component 50 and then manually inserting the connection pin 204 into the slot(s) 120 and/or 122 and hole 68. With this arrangement, the snowplow blade 150 and the blade support component 100 can float up and down with respect to the vehicle attachment component 50 (and thus the vehicle 10) based on the snowplow blade's contact with the ground surface.

If the snowplow blade 150 is pivotal about the pin 200 with respect to the blade support component 100, the snowplow blade 150 may be manually angle positioned (with respect to the vehicle and ground surface) by first manually rotating the snowplow blade 150 with respect to the blade support component 100 about the connection pin 200 from a first condition where the snowplow blade 150 is positioned at a first angle with respect to the vehicle 10 to a second condition where the snowplow blade 150 is positioned at a second different angle with respect to the vehicle 10 and then manually inserting the connection pin 202 into at least one of the holes 162, 164 in the snowplow blade 150 and into the hole 116 in the blade support component 100 to maintain the relative position. If desired, a locking pin (not shown) may be inserted into the corresponding aperture 166 in the wall 160 of the snowplow blade 150 and into the aperture 228 in the connection pin 202 to "lock" the angled position. To move the snowplow blade 150 to a different angled position, it is only necessary to manually remove the locking pin (if used), manually remove the connection pin 202, manually rotate the snowplow blade 150 about the connection pin 200 to the desired position, manually insert the connection pin 200 into the desired hole in the snowplow blade 150 and into the hole 116 in the blade support component 100 and manually insert the locking pin (if used). While three angled positions are shown (see, for example, the three holes 162 shown in FIG. 17), it should be understood that any number of angled positions chosen with the sound judgment of a person of skill in the art could be used.

FIGS. 19-22 show another embodiment of a snowplow assembly 240. Most of the components of the snowplow assembly 240 are similar or identical to the components described above regarding snowplow assembly 30 and thus will not be described again. The primary difference is that rather than using a one-piece snowplow blade, the snowplow assembly 240 uses a snowplow blade 150 that includes a right side portion 242 and a left side portion 244. Each portion 242, 244 may be hollow and may be formed in a rotational molding process.

In one embodiment, each of the right and left side portions 242, 244 have empty voids and each portion weighs less than 50 pounds. In another embodiment, each of the right and left side portions 242, 244 have empty voids and each portion weighs less than 40 pounds. In another embodiment, each of the right and left side portions 242, 244 have empty voids and each portion weighs less than 35 pounds. In one specific embodiment, each of the right and left side portions 242, 244 have empty voids and each portion weighs about 31 pounds. In one embodiment, the voids are filled with foam, adding less than 20 pounds to each of the right and left side portions 242, 244 weights noted above. In another embodiment, the voids are filled with foam, adding less than 15 pounds to each of the right and left side portions 242, 244 weights noted above. In another embodiment, the voids are filled with foam, adding less than 10 pounds to each of the right and left side portions 242, 244 weights noted above. In another embodiment, the voids are filled with foam, adding about 5 pounds to each of the right and left side portions 242, 244 weights noted above. It is also contemplated to add foam to one of the right and left side portions 242, 244 and to leave the other of the right and left side portions 242, 244 with empty voids.

Figure 21:
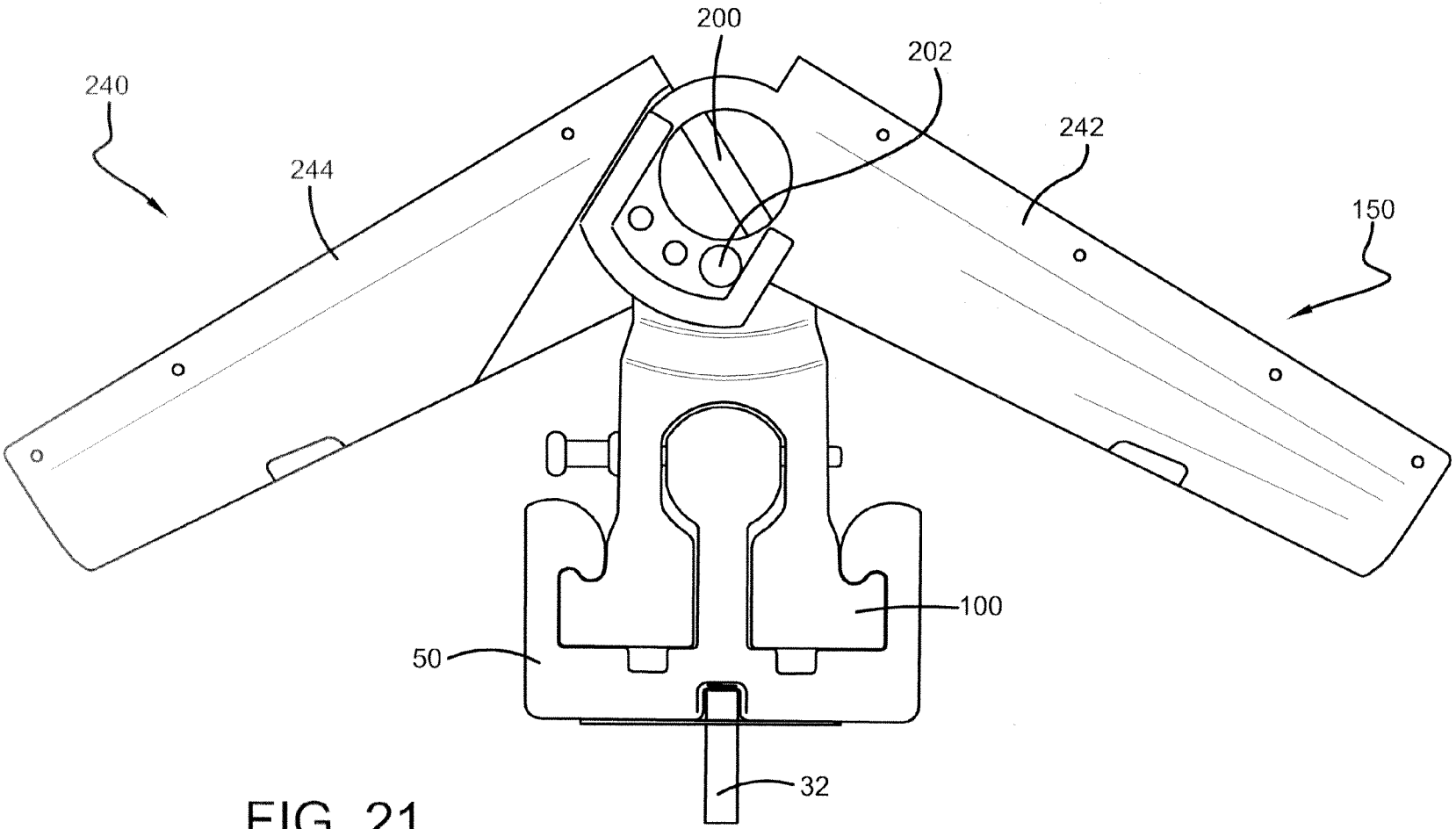
FIG. 21 is a top view of the snowplow assembly shown in FIG. 19.
Figure 22:
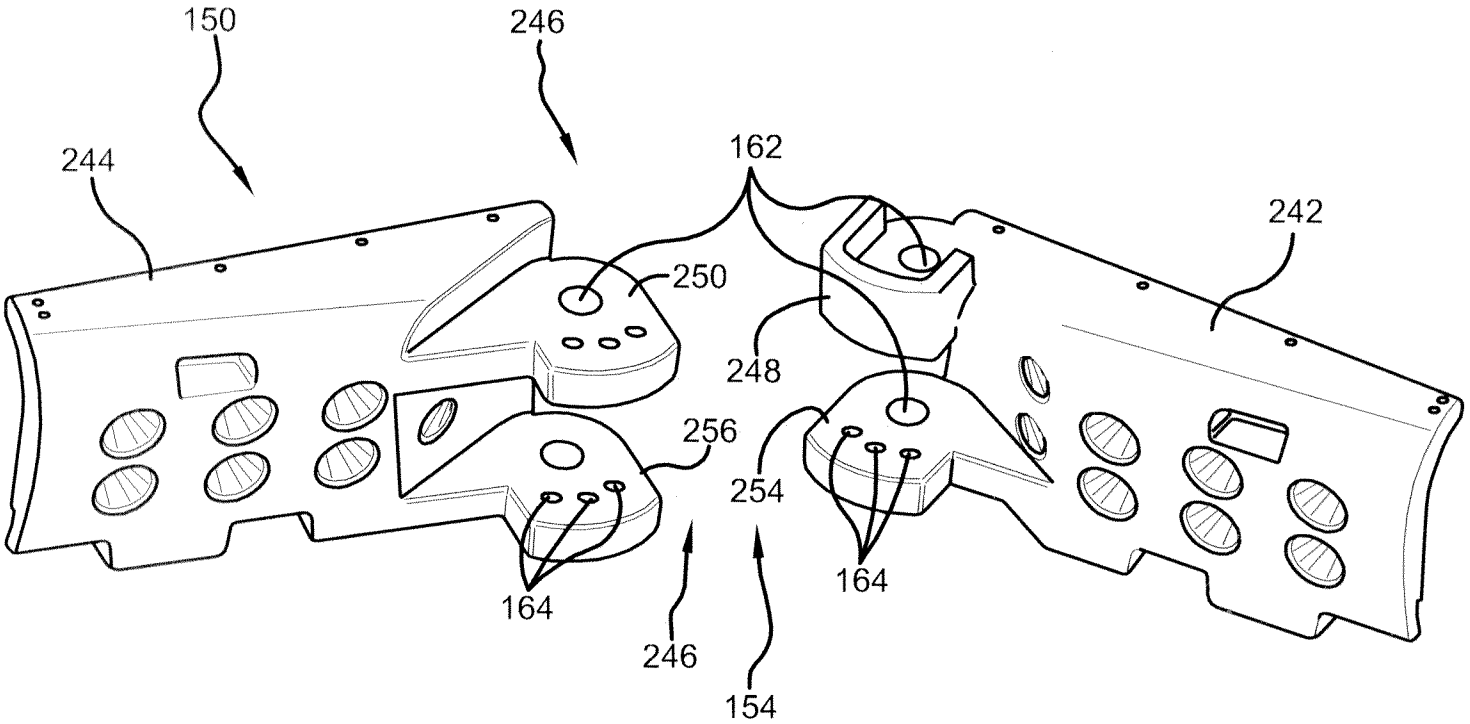
FIG. 22 is a back perspective view of the right and left hand portions of the snowplow blade shown in FIG. 19 but shown disassembled.

With continuing reference to FIGS. 19-22, the right and left sides 242, 244 together form the cavity 154 that receives the extension member 124 of the blade support component 100. In this case, however the upper portion 246 of the snowplow blade 150 is formed by combining the upper portion 248 of the right side portion 242 and the upper portion 250 of the left side portion 244. Similarly, the lower portion 252 of the snowplow blade 150 is formed by combining the lower portion 254 of the right side portion 242 and the lower portion 256 of the left side portion 244. Each of the upper and lower portions 248, 250, 254, 256 may have openings 162 and holes 164 used in the same way as previously described. Except, however, with this embodiment the right and left hand side portions 242, 244 can be pivoted independently around the connection pin 200. In this way, snowplow assembly 240 can be considered to be a "V-plow" since the right and left hand side portions 242, 244 can be adjusted to form a V-shape, as shown in FIG. 21. The connection pin 202 can again be used to maintain the desired relative angular positions.

Figure 23:
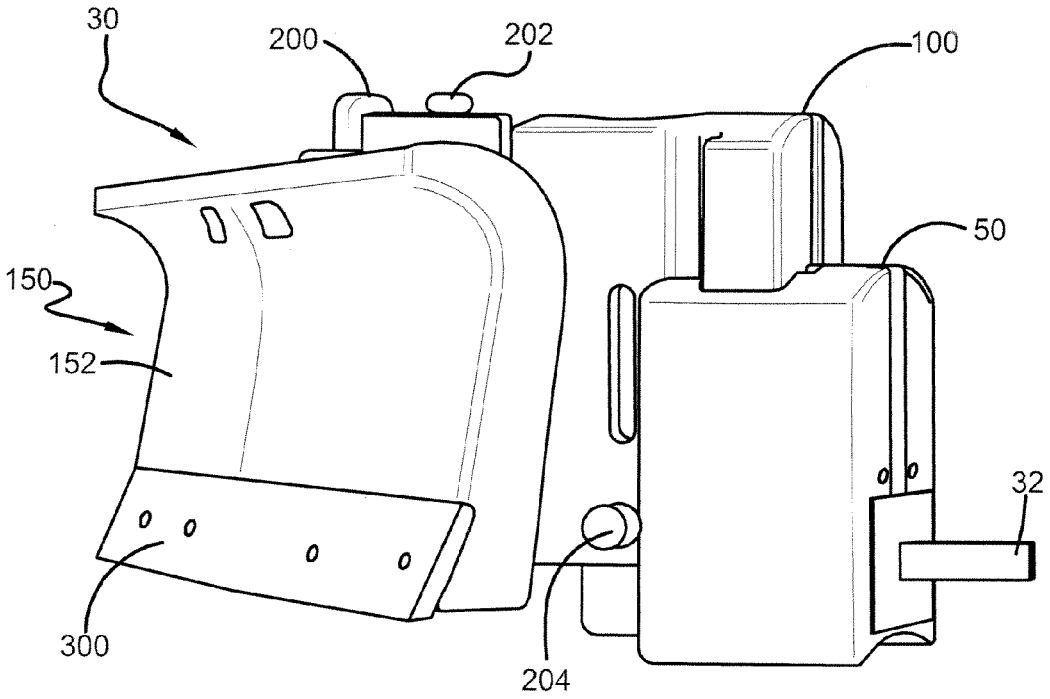
FIG. 23 is a left side view of a snowplow assembly similar to the snowplow assembly shown in FIG. 5 but showing a cutting edge.

With reference now to FIG. 23, in another embodiment the snowplow assembly 30 may include a cutting edge 300 mounted to the bottom of the front surface of the snowplow blade 150, as shown. In one embodiment, the cutting edge 300 is resilient. In one specific embodiment, the cutting edge 300 is formed of rubber. In another specific embodiment, the cutting edge 300 is formed of plastic. Any resilient material chosen with the sound judgment of a person of skill in the art may be used to form the cutting edge 300. In yet another embodiment, the cutting edge 300 may be reversible to extend the life of the cutting edge. By "reversible" it is meant that the cutting edge can be used until one side is worn. Then, the cutting edge can be reversed so that the other side can be used. As various ways of attaching cutting blades to a snowplow blade are well known to those of skill in the art, details will not be provided here. It should be noted that a cutting edge can be used with any snowplow blade of this invention, including with the right and left hand side portions 242, 244 shown in FIG. 19.

Numerous embodiments have been described, hereinabove. It will be apparent to those skilled in the art that the above methods and apparatuses may incorporate changes and modifications without departing from the general scope of this invention. It is intended to include all such modifications and alterations in so far as the come within the scope of the appended claims or the equivalents thereof.

Having thus described the invention, it is now claimed:

We claim:

1. A snowplow assembly comprising:

a mounting member that is mountable to an associated vehicle to support the snowplow assembly to the associated vehicle;

a hollow vehicle attachment component formed in a rotational molding process and comprising: a surface that is attached to the mounting member; first and second arms; first and second channels; and, a hole;

a hollow blade support component formed in a rotational molding process and comprising: first and second arms; first and second channels; first and second holes; a slot; and, an opening;

wherein the first arm of the vehicle attachment component is received in the first channel of the blade support component; the second arm of the vehicle attachment component is received in the second channel of the blade support component; the first arm of the blade support component is received in the first channel of the vehicle attachment component; and, the second arm of the blade support component is received in the second channel of the vehicle attachment component;

a hollow snowplow blade formed in a rotational molding process and comprising: a snow contact surface designed to contact and plow associated snow; first and second holes; and, a first opening;

a first connection pin that is manually insertable into the first opening in the snowplow blade and into the opening in the blade support component to pivotally attach the snowplow blade to the blade support component about the first connection pin;

a second connection pin that is manually adjustable into: (1) a first condition where the second connection pin is removed from at least one of the first hole in the blade support component and the hole in the vehicle attachment component to permit the blade support component to slide relatively downward with respect to the vehicle attachment component as the first arm of the vehicle attachment component slides relative to the first channel of the blade support component, the second arm of the vehicle attachment component slides relative to the second channel of the blade support component, the first arm of the blade support component slides relative to the first channel of the vehicle attachment component and the second arm of the blade support component slides relative to the second channel of the vehicle attachment component so that the snowplow blade is positioned at a snowplow operation height with respect to an associated ground surface; (2) a second condition where the second connection pin is inserted into the first hole in the blade support component and into the hole in the vehicle attachment component to maintain the snowplow blade in a positioned that is above the snowplow operation height; and, (3) a third condition where the second connection pin is inserted into the slot in the blade support component and into the hole in the vehicle attachment component so that the snowplow blade and the blade support component can float up and down with respect to the vehicle attachment component based on the snowplow blade's contact with the associated ground surface; and, a third connection pin that is manually adjustable into: (1) a first condition where the third connection pin is inserted into the first hole in the snowplow blade and the second hole in the blade support component so that the snowplow blade is positioned at a first angle with respect to the associated vehicle; and, (2) a second condition where the third connection pin is inserted into the second hole in the snowplow blade and the second hole in the blade support component so that the snowplow blade is positioned at a second angle with respect to the associated vehicle that is different than the first angle.

2. The snowplow assembly of claim 1 wherein:

the vehicle attachment component comprises a third arm;

the blade support component comprises a third channel;

the third arm of the vehicle attachment component is received in the third channel of the blade support component;

the second connection pin is manually adjustable into the first condition to permit the blade support component to slide relatively downward with respect to the vehicle attachment component as the third arm of the vehicle attachment component slides relative to the third channel of the blade support component so that the snowplow blade is positioned at a snowplow operation height with respect to an associated ground surface.

3. The snowplow assembly of claim 2 wherein:

the vehicle attachment component has a substantial E-shaped cross-section defining a base; first and second outer limbs; and, an inner limb;

the surface of the vehicle attachment component that is attached to the mounting member is on the base of the vehicle attachment component;

the inner limb of the vehicle attachment component defines the first arm of the vehicle attachment component;

the first and second outer limbs of the vehicle attachment component define the second and third arms, respectively, of the vehicle attachment component;

the first channel of the vehicle attachment component is positioned between the first arm and the second arm of the vehicle attachment component;

the second channel of the vehicle attachment component is positioned between the first arm and the third arm of the vehicle attachment component;

the blade support component has a substantial C-shaped cross-section defining a base; and, first and second limbs;

the first and second limbs of the blade support component define the first and second arms, respectively, of the blade support component;

the first channel of the blade support component is positioned between the first and second arms of the blade support component;

the second channel of the blade support component is formed on the first arm of the blade support component;

the third channel of the blade support component is formed on the second arm of the blade support component.

4. The snowplow assembly of claim 3 wherein:

the first arm of the vehicle attachment component has a proximal end with a first thickness T1 and a distal end with a second thickness T2 that is greater than T1;

the first channel of the blade support component has a proximal end with a third thickness T3 and a distal end with a fourth thickness T4 that is less than T3;

T2 is not greater than T3;

the distal end of the first arm of the vehicle attachment component having second thickness T2 is received within the proximal end of the first channel of the blade support component having third thickness T3;

T1 is not greater than T4;

the proximal end of the first arm of the vehicle attachment component having first thickness T1 is received within the distal end of the first channel of the blade support component having fourth thickness T4; and, T2 is greater than T4.

5. The snowplow assembly of claim 3 wherein:

the second arm of the vehicle attachment component has a groove;

the third arm of the vehicle attachment component has a groove;

a ridge that extends from the first arm of the blade support component is received in the groove in the second arm of the vehicle attachment component;

a ridge that extends from the second arm of the blade support component is received in the groove in the third arm of the vehicle attachment component; and, the second connection pin is manually adjustable into the first condition to permit the blade support component to slide relatively downward with respect to the vehicle attachment component as the ridge that extends from the first arm of the blade support component slides in the groove in the second arm of the vehicle attachment component and as the ridge that extends from the second arm of the blade support component slides in the groove in the third arm of the vehicle attachment component so that the snowplow blade is positioned at a snowplow operation height with respect to an associated ground surface.

6. The snowplow assembly of claim 3 wherein:

the hole in the vehicle attachment component is formed in the first arm of the vehicle attachment component; and, the first hole in the blade support component is formed in the first arm of the blade support component.

7. The snowplow assembly of claim 3 wherein:

the hole in the vehicle attachment component extends through the first arm of the vehicle attachment component;

the first hole in the blade support component extends through the first arm of the blade support component;

a third hole in the blade support component extends through the second arm of the blade support component; and, when the second connection pin is in the second condition, the second connection pin extends through the hole in the vehicle attachment component, through the first hole in the blade support component and through the third hole in the blade support component.

8. The snowplow assembly of claim 3 wherein:

the snowplow blade has a cavity behind the snow contact surface and an upper portion that extends above the cavity and a lower portion that extends below the cavity;

the first and second holes of the snowplow blade and the first opening of the snowplow blade are formed in the upper portion of the snowplow blade;

third and fourth holes and a second opening of the snowplow blade are formed in the lower portion of the snowplow blade;

the blade support component comprises an extension member that extends from the base and that is received in the cavity in the snowplow blade;

the second hole and the opening of the blade support component are formed in the extension member of the blade support component;

the first connection pin is manually insertable through the first opening in the snowplow blade, through the opening in the blade support component, and into the second opening in the snowplow blade to pivotally attach the snowplow blade to the blade support component about the first connection pin; and, the third connection pin is manually adjustable into: (1) the first condition where the third connection pin is inserted through the first hole in the snowplow blade, through the second hole in the blade support component, and into the third hole in the snowplow blade so that the snowplow blade is positioned at a first angle with respect to the associated vehicle; and, (2) a second condition where the third connection pin is inserted through the second hole in the snowplow blade, through the second hole in the blade support component, and into the fourth hole in the snowplow blade so that the snowplow blade is positioned at a second angle with respect to the associated vehicle that is different than the first angle.

9. The snowplow assembly of claim 3 wherein:

the vehicle attachment component weighs not more than 25 pounds;

the blade support component weighs not more than 25 pounds; and, the snowplow blade weighs not more than 55 pounds.

10. A snowplow assembly comprising:

a mounting member that is mountable to an associated vehicle to support the snowplow assembly to the associated vehicle;

a hollow vehicle attachment component formed in a rotational molding process and comprising: a surface that is attached to the mounting member; a first arm; a first channel; and, a hole;

a hollow blade support component formed in a rotational molding process and comprising: a first arm; a first channel; a first hole; and, an opening;

wherein the first arm of the vehicle attachment component is received in the first channel of the blade support component and the first arm of the blade support component is received in the first channel of the vehicle attachment component;

a hollow snowplow blade formed in a rotational molding process and comprising: a snow contact surface designed to contact and plow associated snow; and, a first opening;

a first connection pin that is insertable into the first opening in the snowplow blade and into the opening in the blade support component to attach the snowplow blade to the blade support component;

a second connection pin that is adjustable into: (1) a first condition where the second connection pin is removed from at least one of the first hole in the blade support component and the hole in the vehicle attachment component to permit the blade support component to move relatively downward with respect to the vehicle attachment component as the first arm of the vehicle attachment component moves relative to the first channel of the blade support component and the first arm of the blade support component moves relative to the first channel of the vehicle attachment component so that the snowplow blade is positioned at a snowplow operation height with respect to an associated ground surface; and, (2) a second condition where the second connection pin is inserted into the first hole in the blade support component and into the hole in the vehicle attachment component to maintain the snowplow blade in a positioned that is above the snowplow operation height.

11. The snowplow assembly of claim 10 wherein:

the vehicle attachment component weighs not more than 25 pounds;

the blade support component weighs not more than 25 pounds; and, the snowplow blade weighs not more than 55 pounds.

12. The snowplow assembly of claim 11 wherein the entire snowplow assembly weighs not more than 125 pounds.

13. The snowplow assembly of claim 10 wherein:

the first connection pin is manually insertable into the first opening in the snowplow blade and into the opening in the blade support component; and, the second connection pin is manually adjustable into the first and second conditions.

14. The snowplow assembly of claim 10 wherein:

the blade support component has a slot;

the second connection pin is adjustable into a third condition where the second connection pin is inserted into the slot in the blade support component and into the hole in the vehicle attachment component so that the snowplow blade and the blade support component can float up and down with respect to the vehicle attachment component based on the snowplow blade's contact with the associated ground surface.

15. The snowplow assembly of claim 10 wherein:

the snowplow blade comprises a right side portion and a left side portion;

the first opening in the snowplow blade is formed in the right side portion;

a second opening in the snowplow blade is formed in the left side portion; and, the first connection pin is insertable into the second opening in the snowplow blade to attach the snowplow blade to the blade support component.

16. A method comprising the steps of:

(A) providing a snowplow assembly comprising: (1) a mounting member; (2) a hollow vehicle attachment component formed in a rotational molding process and comprising: a surface that is attached to the mounting member; a first arm; a first channel; and, a hole; (3) a hollow blade support component formed in a rotational molding process and comprising: a first arm; a first channel; a first hole; and, a first opening; and, (4) a hollow snowplow blade formed in a rotational molding process and comprising: a snow contact surface designed to contact and plow associated snow; a first opening; (5) a first connection pin; and, (6) a second connection pin;

(B) attaching the vehicle attachment component to the associated vehicle by manually mounting the mounting member to the associated vehicle;

(C) attaching the blade support component to the vehicle attachment component by manually inserting: the first arm of the vehicle attachment component within the first channel of the blade support component; and, the first arm of the blade support component within the first channel of the vehicle attachment component;

(D) attaching the snowplow blade to the blade support component by manually inserting: the first connection pin into the first opening in the snowplow blade and into the first opening in the blade support component; and, (E) positioning the snowplow blade to an above snowplow operation height by: (1) manually sliding the blade support component upward with respect to the vehicle attachment component by sliding the first arm of the vehicle attachment component relative to the first channel of the blade support component and sliding the first arm of the blade support component relative to the first channel of the vehicle attachment component; and, (2) manually inserting the second connection pin into the first hole in the blade support component and into the hole in the vehicle attachment component.

17. The method of claim 16 further comprising the step of:

positioning the snowplow blade to a snowplow operation height with respect to an associated ground surface by: (1) manually removing the second connection pin from at least one of the first hole in the blade support component and the hole in the vehicle attachment component; and, (2) allowing gravity to lower the blade support component with respect to the vehicle attachment component by sliding the first arm of the vehicle attachment component relative to the first channel of the blade support component and sliding the first arm of the blade support component relative to the first channel of the vehicle attachment component.

18. The method of claim 16 wherein:

step (A) comprises the step of: providing the blade support component with a slot; and, the method further comprising the step of: placing the snowplow blade into a float mode by manually inserting the second connection pin into the slot in the blade support component and into the hole in the vehicle attachment component so that the snowplow blade and the blade support component can float up and down with respect to the vehicle attachment component based on the snowplow blade's contact with the associated ground surface.

19. The method of claim 16 wherein:

step (A) comprises the steps of: (1) providing the blade support component with a second hole; (2) providing snowplow blade with first and second holes; and, (3) providing a third connection pin; and, the method further comprising the steps of: (1) rotating the snowplow blade with respect to the blade support component about the first connection pin from a first condition where the snowplow blade is positioned at a first angle with respect to the associated vehicle to a second condition where the snowplow blade is positioned at a second angle with respect to the associated vehicle that is different than the first angle; and, (2) manually inserting the third connection pin into one of the first and second holes in the snowplow blade and into the second hole in the blade support component to maintain the snowplow blade in the second condition.

20. The method of claim 16 wherein:

step (A) comprises the steps of: (1) providing the snowplow blade to comprise a right side portion and a left side portion; (2) providing the first opening in the snowplow blade in the right side portion; (3) providing the left side portion with a second opening in the snowplow blade; (4) providing one of the right side portion and the left side portion with first and second holes and the other of the right side portion and the left side portion with a first hole; and, (5) providing a third connection pin;

step (D) comprises the steps of: (1) attaching the right side portion of the snowplow blade to the blade support component by manually inserting the first connection pin into the first opening in the snowplow blade and into the first opening in the blade support component; and, (2) attaching the left side portion of the snowplow blade to the blade support component by manually inserting the first connection pin into the second opening in the snowplow blade and into the first opening in the blade support component;

the method further comprising the steps of: (1) independently manually rotating the right and left side portions with respect to the blade support component about the first connection pin into desired positions; and, (2) manually inserting the third connection pin into one of the first and second holes in the one of the right side portion and the left side portion; and into the first hole in the other of the right side portion and the left side portion, to maintain the right and left side portions in the desired positions.

* * * * *